US010921724B2

(12) United States Patent
Yawada et al.

(10) Patent No.: US 10,921,724 B2
(45) **Date of Patent: *Feb. 16, 2021**

(54) IMAGE FORMING APPARATUS AND TONER WITH TEMPERATURE-VISCOSITY RELATIONSHIP

(71) Applicant: FUJI XEROX CO., LTD., Tokyo (JP)

(72) Inventors: Teppei Yawada, Kanagawa (JP); Naoki Ota, Kanagawa (JP); Tatsuhiro Igarashi, Kanagawa (JP)

(73) Assignee: FUJI XEROX CO.. LTD., Minato-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/556,492

(22) Filed: Aug. 30, 2019

(65) Prior Publication Data

US 2020/0310307 A1 Oct. 1, 2020

(30) Foreign Application Priority Data

Mar. 25, 2019 (JP) ..... 2019-056540

(51) Int. Cl.
*G03G 9/087* (2006.01)
*G03G 15/16* (2006.01)

(52) U.S. Cl.
CPC ..... *G03G 9/08797* (2013.01); *G03G 15/168* (2013.01); *G03G 15/1685* (2013.01);
(Continued)

(58) Field of Classification Search
None
See application file for complete search history.

(56) References Cited

U.S. PATENT DOCUMENTS 5,114,337 A * 5/1992 Yamazaki ..... G03G 9/08797 219/216
6,040,104 A 3/2000 Nakamura et al.
(Continued)

FOREIGN PATENT DOCUMENTS

JP 02161452 A * 6/1990 ..... G03G 9/08797
JP 3-122659 * 5/1991 ..... G03G 9/87
(Continued)

OTHER PUBLICATIONS

English translation of JP 2017-219756 (Year: 2017).*

*Primary Examiner* — Walter L Lindsay, Jr.
*Assistant Examiner* — Arlene Heredia
(74) *Attorney, Agent, or Firm* — Sughrue Mion, PLLC

(57) ABSTRACT

An image forming apparatus includes an image holding member, a charging unit that charges a surface of the image holding member, an electrostatic charge image forming unit that forms an electrostatic charge image on the charged surface of the image holding member, a developing unit that includes an electrostatic charge image developing toner and that develops the electrostatic charge image on the surface of the image holding member with the electrostatic chare image developing toner to form a toner image, an intermediate transfer body having a circumferential surface of which micro rubber hardness is in a range of 45 to 65, a first transfer unit that first transfers the toner image formed on the surface of the image holding member to a surface of the intermediate transfer body, and a second transfer unit that second transfers the toner image transferred to the surface of the intermediate transfer body to a recording medium, wherein the electrostatic charge image developing toner satisfies the following formulae $$(\ln \eta(T1)-\ln \eta(T2))/(T1-T2)\leq -0.14,$$

$$(\ln \eta(T2)-\ln \eta(T3))/(T2-T3)\geq -0.15, \text{ and}$$

(Continued)

$$(\ln \eta(T1)-\ln \eta(T2))/(T1-T2)<(\ln \eta(T2)-\ln \eta(T3))/(T2-T3)$$

wherein η(T1) represents a viscosity of the electrostatic charge image developing toner at 60° C., η(T2) represents a viscosity of the electrostatic charge image developing toner at 90° C., and η(T3) represents a viscosity of the electrostatic charge image developing toner at 130° C.

15 Claims, 4 Drawing Sheets

(52) U.S. Cl.
CPC ..... *G03G 15/163* (2013.01); *G03G 15/1605* (2013.01); *G03G 15/1675* (2013.01)

(56) References Cited

U.S. PATENT DOCUMENTS 6,537,716 B1 * 3/2003 Doi ..... G03G 9/08755 430/106.1
6,936,392 B2 * 8/2005 Sato ..... G03G 9/08711 430/108.4
7,877,052 B2 * 1/2011 Matsumoto ..... G03G 15/2064 399/328
8,092,969 B2 * 1/2012 Niwa ..... G03G 9/0827 430/123.52
8,728,696 B2 * 5/2014 Yamada ..... G03G 9/0821 430/109.4
9,423,724 B2 8/2016 Ichikawa et al.
10,185,255 B2 1/2019 Kochi et al.
2007/0231727 A1 * 10/2007 Baird et al. ..... G03G 9/08 430/108.4
2016/0313661 A1 * 10/2016 Sekiguchi et al. ..... G03G 9/097

FOREIGN PATENT DOCUMENTS

JP 11-194542 A 7/1999
JP 2015-163933 A 9/2015
JP 2017-219756 A 12/2017
JP 2018-045218 A 3/2018

* cited by examiner

IMAGE FORMING APPARATUS AND TONER WITH TEMPERATURE-VISCOSITY RELATIONSHIP

CROSS-REFERENCE TO RELATED APPLICATIONS

This application is based on and claims priority under 35 USC 119 from Japanese Patent Application No. 2019-056540 filed Mar. 25, 2019.

BACKGROUND

(i) Technical Field

The present disclosure relates to an image forming apparatus.

(ii) Related Art

An electrophotographic process for forming an image, for example, includes charging the surface of an image holding member, forming an electrostatic charge image on this surface of the image holding member on the basis of image information, developing the electrostatic charge image with toner to form a toner image, and transferring and fixing the toner image to the surface of a recording medium. An enhancement in efficiency of the transfer of the toner image to the recording medium has been demanded in terms of formation of a high-quality image, and an improvement in such a regard has been studied.

Japanese Laid Open Patent Application Publication No. 2015-163933, for instance, discloses a pressure device including a pressure member that pushes a member that is to be pressed, two side plates that individually support the two ends of the pressure member in the longitudinal direction, multiple regulation units connected to each of the two side plates to regulate relative movement of the two side plates in the longitudinal direction, and a pushing unit that applies a pushing force to at least one of the two side plates and multiple regulation units to push the pressure member to the member that is to be pressed, wherein at least one of the multiple regulation units is a position-variable regulation unit that is connected to the two side plates such that the relative position of its connection part with one of the two side plates to the connection part with the other side plate in the pressing direction can change.

Japanese Laid Open Patent Application Publication No. 2017-219756 discloses an image forming apparatus including an image forming unit that forms a toner image, an image holding member that has a surface on which the toner image formed by the image forming unit is carried and that can be elastically deformed, a nip forming member that abuts on the image holding member to form a transfer nip, and a transfer power source that applies a transfer bias for transferring the toner image on the surface of the image holding member to a recording sheet held in the transfer nip, wherein the micro rubber hardness of the image holding member is from 45 to 65, and the dielectric constant of toner used in the image forming unit is 3.9 or less.

Japanese Laid Open Patent Application Publication No. 2018-045218 discloses an image forming apparatus in which a transfer bias that is a superimposed voltage in which a direct-current voltage and an alternating-current voltage have been superimposed is output from a transfer power source and in which a toner image on the surface of an image holding member is transferred to recording sheet held in a transfer nip formed by abutting of the image holding member on a nip-forming member while a transfer electric current is applied to the transfer nip, wherein the micro rubber hardness of the image holding member is less than 100, two peak values in the transfer bias include a transfer peak for stronger electrostatic move of toner in the transfer nip from the image holding member to the nip forming member and an opposite peak thereto, and opposite-peak-side duty that is a duty for the opposite peak is less than 50[%].

Japanese Laid Open Patent Application Publication No. 11-194542 discloses an electrophotographic toner containing a binder resin and a colorant, wherein the binder resin is a resin in which the minimum of tan δ of the binder resin exists between the glass transition temperature (Tg) and the temperature that gives the loss modulus (G") of $G''=1\times10^4$ Pa, in which the minimum of tan δ is less than 1.2, in which the storage modulus (G') at the temperature of the minimum of tan δ is $G'=5\times10^5$ Pa or more, and in which the value of tan δ at a temperature that gives $G''=1\times10^4$ Pa is 3.0 or more.

In image forming apparatuses, a technique that can produce high transfer efficiency regardless of the type of a recording medium (such as a recording medium having an uneven surface or a recording medium having a highly smooth surface) has been demanded. From such a viewpoint, a technique involving use of an intermediate transfer body having a low surface hardness, such as an intermediate transfer body of which the circumferential surface has a micro rubber hardness ranging from 45 to 65, has been suggested.

In image forming apparatuses, however, use of an intermediate transfer body of which the circumferential surface has a micro rubber hardness ranging from 45 to 65 may cause the occurrence of image defects, such as a white spot and fading, in some cases.

SUMMARY

Aspects of non-limiting embodiments of the present disclosure relate to an image forming apparatus that includes an image holding member, a charging unit, an electrostatic charge image forming unit, a developing unit that develops an electrostatic charge image on the surface of the image holding member with an electrostatic charge image developing toner containing toner particles and an external additive to form a toner image, an intermediate transfer body of which the circumferential surface has a micro rubber hardness ranging from 45 to 65, a first transfer unit, and a second transfer unit and that enables a reduction in the occurrence of a white spot and fading in formation of an image on a recording medium having an uneven surface as compared with the case where the electrostatic charge image developing toner has $(\ln \eta(T1)-\ln \eta(T2))/(T1-T2)$ of greater than −0.14 or $(\ln \eta(T2)-\ln \eta(T3))/(T2-T3)$ of less than −0.15.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image holding member, a charging unit that charges a surface of the image holding member, an electrostatic charge image forming unit that forms an electrostatic charge image on the charged surface of the image holding member, a developing unit that includes an electrostatic charge image developing toner and that develops the electrostatic charge image on the surface of the image holding member with the electrostatic chare image developing toner to form a toner image, an intermediate transfer body having a circumferential surface of which micro rubber hardness is in a range of 45 to 65, a first transfer unit that first transfers the toner image formed on the surface of the image holding member to a surface of the intermediate transfer body, and a second transfer unit that second transfers the toner image transferred to the surface of the intermediate transfer body to a recording medium, wherein the electrostatic charge image developing toner satisfies the following formulae $$(\ln \eta(T1)-\ln \eta(T2))/(T1-T2)\leq -0.14,$$

$$(\ln \eta(T2)-\ln \eta(T3))/(T2-T3)\geq -0.15, \text{ and}$$

$$(\ln \eta(T1)-\ln \eta(T2))/(T1-T2)<(\ln \eta(T2)-\ln \eta(T3))/(T2-T3)$$

wherein η(T1) represents a viscosity of the electrostatic charge image developing toner at 60° C., η(T2) represents a viscosity of the electrostatic charge image developing toner at 90° C., and η(T3) represents a viscosity of the electrostatic charge image developing toner at 130° C.

BRIEF DESCRIPTION OF THE DRAWINGS

Exemplary embodiment of the present disclosure will be described in detail based on the following figures, wherein.

DETAILED DESCRIPTION

Figure 1:
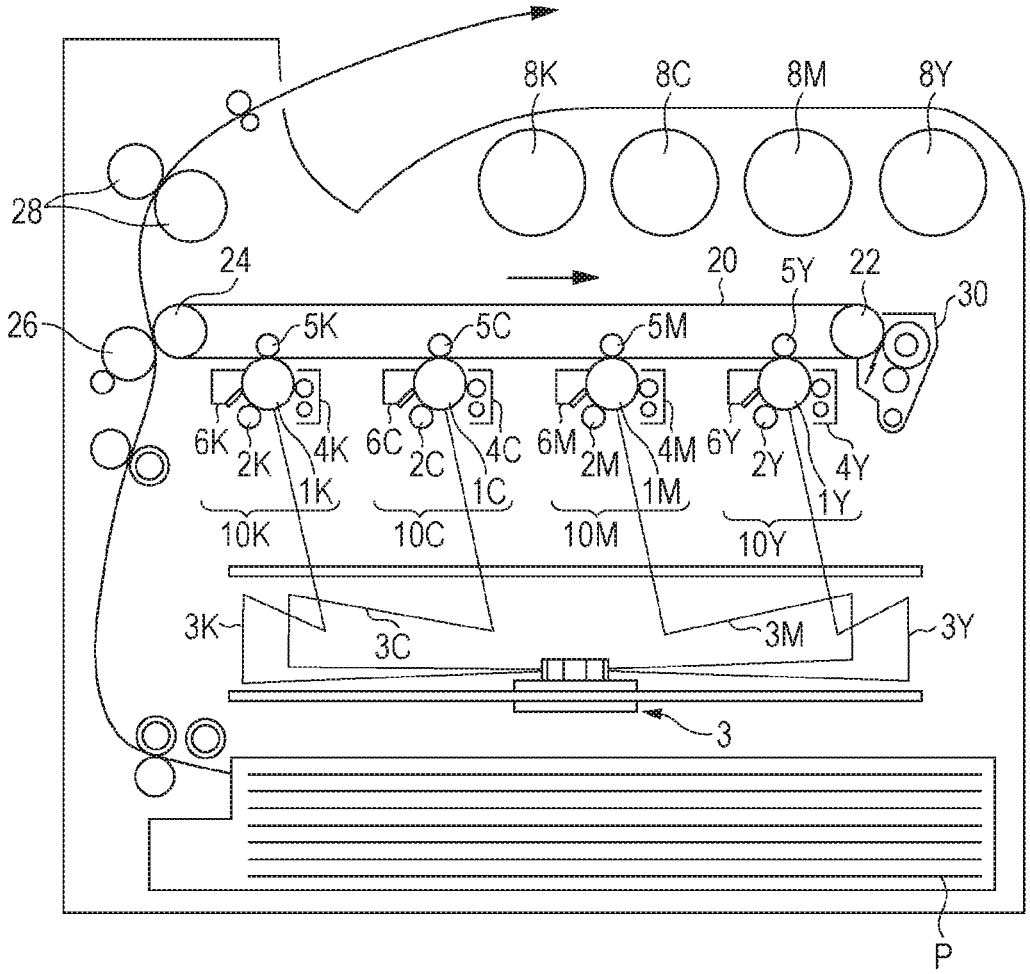
FIG. 1 schematically illustrates the structure of an example of an image forming apparatus according to an exemplary embodiment.

An exemplary embodiment that is an example of the present disclosure will now be described in detail.

Image Forming Apparatus

An image forming apparatus according to an exemplary embodiment includes an image holding member, a charging unit that charges the surface of the image holding member, an electrostatic charge image forming unit that forms an electrostatic charge image on the charged surface of the image holding member, a developing unit that has an electrostatic charge image developing toner and that develops the electrostatic charge image on the surface of the image holding member with the electrostatic charge image developing toner to form a toner image, an intermediate transfer body, a first transfer unit that first transfers the toner image formed on the surface of the image holding member to the surface of the intermediate transfer body and a second transfer unit that second transfers the toner image transferred to the surface of the intermediate transfer body to a recording medium.

The circumferential surface of the intermediate transfer body has a micro rubber hardness ranging from 45 to 65.

The electrostatic charge image developing toner contains toner particles and an external additive. When the electrostatic charge image developing toner has a viscosity η(T1) at a temperature T1 of 60° C., a viscosity η(T2) at a temperature T2 of 90° C., and a viscosity η(T3) at a temperature T3 of 130° C., (ln η(T1)−ln η(T2))/(T1−T2) is −0.14 or less, (ln η(T2)−ln η(T3))/(T2−T3) is −0.15 or more, and (ln η(T2)−ln η(T3))/(T2−T3) is greater than (ln η(T1) −ln η(T2))/(T1−T2). The electrostatic charge image developing toner having such characteristics is hereinafter also simply referred to as "specific toner".

The image forming apparatus having the above-mentioned structure according to the exemplary embodiment enables a reduction in the occurrence of a white spot and fading in formation of an image on a recording medium having an uneven surface.

The mechanism thereof is speculated as follows.

The characteristics of the specific toner used in the exemplary embodiment will now be described. The formula (ln η(T1)−ln η(T2))/(T1−T2) is an index that indicates the degree of a change in the viscosity of the toner in a temperature range from 60° C. to 90° C., and its value of −0.14 or less means that the toner undergoes a large viscosity change in a temperature range from 60° C. to 90° C. The formula (ln η(T2)−ln η(T3))/(T2−T3) is an index that indicates the degree of a change in the viscosity of the toner in a temperature range from 90° C. to 120° C., and its value of −0.15 or more and the value of (ln η(T2)−ln η(T3))/(T2−T3) being greater than the value of (ln η(T1)−ln η(T2))/(T1−T2) mean that the toner undergoes a small viscosity change in a temperature range from 90° C. to 120° C. Accordingly, the specific toner has a sharp viscosity change in a temperature range from 60° C. to 90° C. and a small viscosity change in a temperature range from 90° C. to 120° C.

In the toner having such characteristics in viscosity change, it is believed that a low molecular weight component and a high molecular weight component are contained at an appropriate proportion in a binder resin used in the toner particles. In other words, using a low molecular weight component in the binder resin makes it easy to change the viscosity in a temperature range from 60° C. to 90° C., and using a high molecular weight component in the binder resin makes it hard to change the viscosity in a higher temperature range from 90° C. to 120° C.

The specific toner having the above-mentioned characteristics of viscosity change is believed to have a small viscosity change and a proper viscoelasticity in a temperature range from room temperature (such as 20° C.) to 60° C. Hence, using a low molecular weight component and a high molecular weight component at an appropriate proportion in a binder resin used in the specific toner makes it hard to change the viscosity in a temperature range of 60° C. or less and keeps the viscoelasticity of the toner in a proper range. Accordingly, it is believed that the specific toner having the above-mentioned characteristics is less likely to undergo a viscosity change in a temperature range from a room temperature to 60° C. and has a proper viscoelasticity.

In recent image forming apparatuses, a technique that can produce high transfer efficiency regardless of the type of a recording medium (such as a recording medium having an uneven surface or a recording medium having a highly smooth surface) has been demanded for the necessity of adaptability to recording media and enhanced image quality. From this standpoint, a technique involving use of an intermediate transfer body having a surface with a small hardness, specifically an intermediate transfer body having a circumferential surface with a micro rubber hardness ranging from 45 to 65, has been proposed. The intermediate transfer body having a surface with small hardness enables nip width to be formed in the second transfer part so as to reflect the surface profile of a recording medium, in other words whether the surface of the recording medium has unevenness or not (namely, low smoothness or high smoothness). Hence, even when a recording medium having unevenness (namely, low smoothness) is used, pressure from the intermediate transfer body is sufficiently applied to the inside of the recess of the uneven surface profile, which gives stable transfer performance regardless of the type of a recording medium.

In an image forming apparatus including an intermediate transfer body having a circumferential surface with a micro rubber hardness ranging from 45 to 65, however, using a toner having excessively high or low viscoelasticity at an environmental temperature [normally from room temperature (such as 20° C.) to 60° C.] in the second transfer part causes the occurrence of image defects, such as a white spot or fading, in some cases.

In particular, the following case is assumed: a toner having a low viscoelasticity is used, and a low-density image is formed on a recording medium having unevenness (namely, low smoothness) at a high-temperature and high-humidity condition (for example, 28° C. and 85% RH). The toner having a low viscoelasticity is likely to become softer when it is stored inside a developing device under a high-temperature and high-humidity condition. In formation of a low-density image, the amount of toner to be supplied from the developing device becomes small, and the toner stays inside the developing device for a long duration; hence, the toner is likely to receive a load, and an external additive is likely to be embedded into the surface of the softened toner. Consequently, the toner becomes highly adhesive. In the second transfer part in which a recording medium having an uneven surface contacts with the intermediate transfer body, nip pressure becomes high as the nip width becomes large (nip pressure becomes high particularly at a protrusion on the unevenness of the recording medium), which results in easy adhesion of the highly adhesive toner to the intermediate transfer body. This phenomenon is believed to reduce efficiency of the transfer from the intermediate transfer body to the recording medium and thus cause a white spot or fading to occur in an image so as to correspond to the part of the intermediate transfer body in which the transfer to the recording medium has failed.

Furthermore, the following case is assumed: a toner having a high viscoelasticity is used, and a low-density image is formed on a recording medium having unevenness (namely, low smoothness) at a low temperature and low humidity condition (for example, 10° C. and 15% RH). The toner having a high viscoelasticity is likely to become harder when it is stored inside a developing device under a low temperature and low humidity condition, and an external additive becomes likely to be released from the surface of the hardened toner. In the second transfer part in which a recording medium having an uneven surface contacts with the intermediate transfer body, nip pressure becomes high as the nip width becomes large (nip pressure becomes high particularly at a protrusion on the unevenness of the recording medium), which results in release of an external additive from the surface of the toner and easy adhesion of toner with reduced transfer efficiency to the intermediate transfer body. Hence, toner on some parts of the intermediate transfer body is not transferred to the recording medium. Thus, in the case where a high-density image is formed, the part of the image in which the toner has not been transferred is easy to be recognized, which results in the occurrence of a white spot or fading.

In the exemplary embodiment, the specific toner is used; in other words, toner having an appropriate viscoelasticity is used. Hence, even in the case where a low-density image is formed on a recording medium having unevenness (namely, low smoothness) at a high-temperature and high-humidity condition (such as 28° C. and 85% RH), an increase in the adhesiveness of the toner is reduced. Then, the adhesion of the toner to the intermediate transfer body is reduced in the second transfer part, so that the occurrence of a white spot and fading in an image is reduced. Moreover, even in the case where a low-density image is formed on a recording medium having unevenness (namely, low smoothness) at a low-temperature and low-humidity condition (such as 10° C. and 15% RH), an external additive is restrained from being released from the surface of the toner. Accordingly, the adhesion of the toner to the intermediate transfer body is reduced in the second transfer part, so that the occurrence of a white spot and fading in an image is reduced.

The image forming apparatus according to the exemplary embodiment enables a reduction in the occurrence of a white spot and fading in formation of image on a recording medium having an uneven surface as described above.

In the present disclosure, the term "white spot" refers to an image defect in which an image formed on a recording medium has a blank in the form of a white dot, and the term "fading" refers to an image defect in which the colored part of an image formed on a recording medium does not have the intended color and is therefore blank in the form of a dot Each of the members or parts of the image forming apparatus according to the exemplary embodiment will now be described in detail.

Electrostatic Charge Image Developer

The electrostatic charge image developer accommodated in the developing unit in the image forming apparatus according to the exemplary embodiment will be described.

The electrostatic charge image developer according to the exemplary embodiment contains at least the specific toner. The electrostatic charge image developer may be a single-component developer containing only the specific toner or may be a two-component toner containing the specific toner and a carrier.

Electrostatic Charge Image Developing Toner

The specific toner contains toner particles and an external additive.

Characteristic Value of Temperature and Viscosity of Toner

The specific toner has the following characteristics:

$(\ln \eta(T1)-\ln \eta(T2))/(T1-T2)$ is $-0.14$ or less, $(\ln \eta(T2)-\ln \eta(T3))/(T2-T3)$ is $-0.15$ or more, and $(\ln \eta(T2)-\ln \eta(T3))/(T2-T3)$ is greater than $(\ln \eta(T1)-\ln \eta(T2))/(T1-T2)$, wherein the viscosity $\eta$ of the specific toner at a temperature T1 of 60° C. is $\eta(T1)$, the viscosity $\eta$ thereof at a temperature T2 of 90° C. is $\eta(T2)$, and the viscosity $\eta$ thereof at a temperature T3 of 130° C. is $\eta(T3)$.

In the present disclosure, "$\ln \eta(T1)$" is the value of natural logarithm for the viscosity $\eta$ of the toner at a temperature T1 of 60° C.

The unit of the viscosity of the toner is Pa·s in the present disclosure unless otherwise specified.

The viscosity of the toner at the individual temperatures in the exemplary embodiment is measured in the following manner.

In the exemplary embodiment, a rotational plate rheometer (RDA2, RHIOS system ver.4.3 manufactured by Rheometrics, Inc) is used to measure the viscosity of the toner with a parallel plate having a diameter of 8 mm while temperature is increased from approximately 30° C. to 150°

C. at a rate of 1° C./min and a sample weight of approximately 0.3 g under application of a frequency of 1 Hz and strain of 20% or lower.

The value of (ln η(T1)−ln η(T2))/(T1−T2), which is one of the characteristic values of the specific toner, is −0.14 or less, preferably −0.16 or less, more preferably from −0.30 to −0.18, and especially preferably from −0.25 to −0.20 in terms of a reduction in the occurrence of a white spot and fading in an image to be formed.

The value of (ln η(T2)−ln η(T3))/(T2−T3), which is one of the characteristic values of the specific toner, is −0.15 or more, preferably greater than −0.14, more preferably −0.13 or more, further preferably from −0.12 to −0.03, and especially preferably from −0.11 to −0.05 in terms of a reduction in the occurrence of a white spot and fading in an image to be formed.

In addition, the value of (ln η(T2)−ln η(T3))/(T2−T3) is greater than the value of (ln η(T1)−ln η(T2))/(T1−T2) in the specific toner; in terms of a reduction in the occurrence of a white spot and fading in an image to be formed, the value of {(ln η(T2)−ln η(T3))/(T2−T3)}−{(ln η(T1)−ln η(T2))/(T1−T2)} is preferably 0.01 or more, and more preferably from 0.05 to 0.5, and especially preferably from 0.08 to 0.2.

When the viscosity η of the specific toner at a temperature T0 of 40° C. is η(T0), the specific toner has the following characteristics:

(ln η(T0)−ln η(T1))/(T0−T1) is suitably −0.12 or more, and (ln η(T0)−ln η(T1))/(T0−T1) is suitably greater than (ln η(T1)−ln η(T2))/(T1−T2).

When the value of (ln η(T0)−ln η(T1))/(T0−T1) in the specific toner is −0.12 or less, the occurrence of a white spot and fading in an image to be formed is likely to be further reduced. The value of (ln η(T0)−ln η(T1))/(T0−T1) is preferably −0.05 or less, and especially preferably from −0.11 to −0.06.

Furthermore, when the value of (ln η(T0)−ln η(T1))/(T0−T1) is greater than the value of (ln η(T1)−ln η(T2))/(T1−T2) in the specific toner, the occurrence of a white spot and fading in an image to be formed is likely to be further reduced. The value of {(ln η(T0)−ln η(T1))/(T0−T1)}−{(ln η(T1)−ln η(T2))/(T1−T2)} is preferably 0.01 or more, and more preferably from 0.05 to 0.5, and especially preferably from 0.08 to 0.2.

The characteristic values of the temperature and viscosity of the toner, namely the characteristic values of (ln η(T1)−ln η(T2))/(T1−T2), (ln η(T2)−ln η(T3))/(T2−T3), and (ln η(T0)−ln η(T1))/(T0−T1), can be adjusted to be within the above-mentioned ranges by any methods. The characteristic values can be, for example, adjusted by controlling the molecular weight in a binder resin contained in the toner particles, specifically by controlling the molecular weights and amounts of a low molecular weight component and high molecular weight component. In the case where the toner particles are produced by an aggregation coalescence method that will be described later, the characteristic values can be also adjusted by controlling the degree of aggregation, for instance, through adjusting the amount of a coagulant.

In the specific toner, the viscosity η(T0) of the toner at a temperature T0 of 40° C., the viscosity η(T1) thereof at a temperature T1 of 60° C., the viscosity η(T2) thereof at a temperature T2 of 90° C., and the viscosity η(T3) thereof at a temperature T3 of 130° C. are preferably within the following ranges in terms of a reduction in the occurrence of a white spot and fading in an image to be formed.

η(T0): from $1.0\times10^7$ to $1.0\times10^9$ (more preferably from $2.0\times10^7$ to $5.0\times10^8$)

η(T1): from $1.0\times10^5$ to $1.0\times10^8$ (more preferably from $1.0\times10^6$ to $5.0\times10^7$)

η(T2): from $1.0\times10^3$ to $1.0\times10^5$ (more preferably from $5.0\times10^3$ to $5.0\times10^4$)

η(T3): from $1.0\times10^2$ to $1.0\times10^4$ (more preferably from $1.0\times10^2$ to $5.0\times10^3$)

Maximum Endothermic Peak Temperature of Toner

The maximum endothermic peak temperature of the specific toner is preferably from 70° C. to 100° C., more preferably from 75° C. to 95° C., and especially preferably from 83° C. to 93° C.

The term "maximum endothermic peak temperature" of the specific toner refers to a temperature that gives the maximum endothermic peak in an endothermic curve including at least a range from −30° C. to 150° C. in differential scanning calorimetry.

The maximum endothermic peak temperature of the specific toner is measured as follows.

A differential scanning calorimeter DSC-7 manufactured by PerkinElmer Inc. is used, the melting points of indium and zinc are utilized for temperature correction in the detector of the apparatus, and the heat of the fusion of indium is used to correct the quantity of heat. An aluminum pan is used for a sample, and an empty pan is used for comparison. The temperature is increased from room temperature to 150° C. at a rate of 10° C./min, decreased from 150° C. to −30° C. at a rate of 10° C./min, and increased from −30° C. to 150° C. at a rate of 10° C./min; and the temperature of the maximum endothermic peak in the second temperature increase is defined as the maximum endothermic peak temperature.

Infrared Absorption Spectrum of Toner Particles

In the case where the specific toner contains an amorphous polyester resin, which will be described later, as a binder resin, the infrared absorption spectrometry of the toner particles suitably gives the following ratios of absorbance in terms of a reduction in the occurrence of a white spot and fading in an image that is to be formed: the ratio of the absorbance at a wavenumber of 1,500 $cm^{-1}$ to the absorbance at a wavenumber of 720 $cm^{-1}$ (absorbance at a wavenumber of 1,500 cm/absorbance at a wavenumber of 720 $cm^{-1}$) is 0.6 or less, and the ratio of the absorbance at a wavenumber of 820 $cm^{-1}$ to the absorbance at a wavenumber of 720 $cm^{-1}$ (absorbance at a wavenumber of 820 $cm^{-1}$/absorbance at a wavenumber of 720 $cm^{-1}$) is 0.4 or less. Moreover, in the infrared absorption spectrometry of the toner particles, the ratio of the absorbance at a wavenumber of 1,500 $cm^{-1}$ to the absorbance at a wavenumber of 720 $cm^{-1}$ is preferably 0.4 or less, and the ratio of the absorbance at a wavenumber of 820 $cm^{-1}$ to the absorbance at a wavenumber of 720 $cm^{-1}$ is preferably 0.2 or less; the ratio of the absorbance at a wavenumber of 1,500 $cm^{-1}$ to the absorbance at a wavenumber of 720 $cm^{-1}$ is especially preferably from 0.2 to 0.4, and the ratio of the absorbance at a wavenumber of 820 $cm^{-1}$ to the absorbance at a wavenumber of 720 $cm^{-1}$ is especially preferably from 0.05 to 0.2.

In the exemplary embodiment, the absorbance at the individual wavenumbers is measured by infrared absorption spectrometry as follows. Toner particles (external additive is optionally removed from toner) that are to be analyzed are formed into a test sample by a KBr pellet technique. The test sample is analyzed in the wavenumber range of 500 $cm^{-1}$ to 4000 $cm^{-1}$ with an infrared spectrophotometer (FT-IR-410 manufactured by JASCO Corporation) at number of integration of 300 times and resolution of 4 $cm^{-1}$. Baseline correction is carried out at, for instance, an offset part having no light absorption to determine the absorbance for the individual wavenumbers.

In the specific toner, the ratio of the absorbance at a wavenumber of 1,500 $cm^{-1}$ to the absorbance at a wavenumber of 720 $cm^{-1}$ in the infrared absorption spectrometry of the toner particles is preferably 0.6 or less, more preferably 0.4 or less, further preferably from 0.2 to 0.4, and especially preferably from 0.3 to 0.4 in terms of a reduction in the occurrence of a white spot and fading in an image to be formed.

Furthermore, in the specific toner, the ratio of the absorbance at a wavenumber of 820 $cm^{-1}$ to the absorbance at a wavenumber of 720 $cm^{-1}$ in the infrared absorption spectrometry of the toner particles is preferably 0.4 or less, more preferably 0.2 or less, further preferably from 0.05 to 0.2, and especially preferably from 0.08 to 0.2 in terms of a reduction in the occurrence of a white spot and fading in an image to be formed.

Toner Particles

The toner particles, for example, contain a binder resin and optionally a colorant, a release agent, and another additive; and suitably a binder resin and a release agent.

In the exemplary embodiment, non-limiting examples of the toner particles include toner particles of yellow toner, magenta toner, cyan toner, or black toner; white toner particles; transparent toner particles; and luminous toner particles.

Binder Resin

Examples of the binder resin include vinyl resins that are homopolymers of monomers such as styrenes (such as styrene, p-chlorostyrene, and α-methylstyrene); (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate); ethylenically unsaturated nitriles (such as acrylonitrile and methacrylonitrile); vinyl ethers (such as vinyl methyl ether and vinyl isobutyl ether); vinyl ketones (such as vinyl methyl ketone, vinyl ethyl ketone, and vinyl isopropenyl ketone); and olefins (such as ethylene, propylene, and butadiene) or copolymers of two or more of these monomers.

Other examples of the binder resin include non-vinyl resins such as epoxy resins, polyester resins, polyurethane resins, polyamide resins, cellulose resins, polyether resins, and modified rosin; mixtures of these non-vinyl resins with the above-mentioned vinyl resins; and graft polymers obtained by polymerization of a vinyl monomer in the coexistence of such non-vinyl resins.

These binder resins may be used alone or in combination.

In particular, the binder resin preferably contains at least one selected from the group consisting of a styrene-acrylic resin and an amorphous polyester resin, and more preferably a styrene-acrylic resin or an amorphous polyester resin in terms of a reduction in the occurrence of a white spot and fading in an image to be formed. The binder resin further preferably contains a styrene-acrylic resin or an amorphous polyester resin in an amount of 50 mass % or more relative to the total mass of the binder resin contained in the toner, and especially preferably in an amount 80 mass % or more relative to the total mass of the binder resin contained in the toner.

The specific toner suitably contains a styrene-acrylic resin as a binder resin in terms of the strength and storage stability of the toner.

The specific toner suitably contains an amorphous polyester resin as a binder resin in terms of fixability at low temperature.

An amorphous polyester resin to be used is suitably an amorphous polyester resin having no bisphenol structure in terms of a reduction in the occurrence of a white spot and fading in an image to be formed and fixability.

Styrene-Acrylic Resin

The binder resin is suitably a styrene-acrylic resin.

A styrene-acrylic resin is a copolymer produced by at least copolymerization of styrene monomer (monomer having a styrene skeleton) with a (meth)acrylic monomer [monomer having a (meth)acrylic group, suitably a monomer having a (meth)acryloxy group]. The styrene-acrylic resin, for example, includes a copolymer of a monomer of styrene with a monomer of the above-mentioned (meth) acrylates.

The acrylic resin moiety of the styrene-acrylic resin is a partial structure formed by polymerization of either one or both of an acrylic monomer and a methacrylic monomer. The term "(meth)acryl" comprehensively refers to each of "acryl" and "methacryl".

Specific examples of the styrene monomer include styrene; alkyl-substituted styrene (such as α-methylstyrene, 2-methylstyrene, 3-methylstyrene, 4-methylstyrene, 2-ethylstyrene, 3-ethylstyrene, and 4-ethylstyrene); halogen-substituted styrene (such as 2-chlorostyrene, 3-chlorostyrene, and 4-chlorostyrene); and vinylnaphthalene. The styrene monomers may be used alone or in combination.

Among those styrene monomers, styrene is suitable in terms of good reactivity, easiness of controlling the reaction, and availability.

Specific examples of the (meth)acrylic monomer include (meth)acrylic acid and (meth)acrylate. Examples of the (meth)acrylate include alkyl (meth)acrylate [such as methyl (meth)acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth) acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth) acrylate, cyclohexyl (meth)acrylate, and t-butylcyclohexyl (meth)acrylate]; aryl (meth)acrylate [such as phenyl (meth) acrylate, biphenyl (meth)acrylate, diphenylethyl (meth) acrylate, t-butylphenyl (meth)acrylate, and terphenyl (meth) acrylate]; dimethylaminoethyl (meth)acrylate; diethylaminoethyl (meth)acrylate; methoxyethyl (meth) acrylate; 2-hydroxyethyl (meth)acrylate; β-carboxyethyl (meth)acrylate; and (meth) acrylamide. These (meth)acrylic monomers may be used alone or in combination.

Among those (meth)acrylic monomers, a suitable (meth) acrylate is a (meth)acrylate having an alkyl group with from 2 to 14 carbon atoms (preferably from 2 to 10 carbon atoms, more preferably from 3 to 8 carbon atoms) in terms of fixability.

In particular, n-butyl (meth)acrylate is preferred, and n-butyl acrylate is especially preferred.

The copolymerization ratio of the styrene monomer to the (meth)acrylic monomer (styrene monomer/(meth)acrylic monomer on a mass basis) is not particularly limited but suitably from 85/15 to 70/30.

The styrene-acrylic resin suitably has a cross-linked structure in terms of a reduction in the occurrence of a white spot and fading in an image to be formed. Suitable examples of the styrene-acrylic resin having a cross-linked structure include styrene-acrylic resins produced by at least copolymerization of a styrene monomer with a (meth)acrylic monomer and a cross-linkable monomer.

Examples of the cross-linkable monomer include bifunctional or higher functional crosslinking agents.

Examples of the bifunctional crosslinking agents include divinyl benzene; divinyl naphthalene; di(meth)acrylate compounds [such as diethylene glycol di(meth)acrylate, methylene bis(meth)acrylamide, decanediol diacrylate, and glycidyl (meth)acrylate]; polyester type di(meth)acrylate; and 2-([1'-methyl propylidene amino]carboxyamino)ethyl methacrylate.

Examples of the polyfunctional crosslinking agents include tri(meth)acrylate compounds [such as pentaerythritol tri(meth)acrylate, trimethylolethane tri(meth)acrylate, and trimethylolpropane tri(meth)acrylate]; tetra(meth)acrylate compounds [such as pentaerythritol tetra(meth)acrylate and oligoester (meth)acrylate]; 2,2-bis(4-methacryloxy polyethoxyphenyl)propane; diallyl phthalate; triallyl cyanurate; triallyl isocyanurate; triallyl trimellitate; and diallyl chlorendate.

Among them, the cross-linkable monomer is preferably a bifunctional or higher functional (meth)acrylate compound, more preferably a bifunctional (meth)acrylate compound, further preferably a bifunctional (meth)acrylate compound having an alkylene group with from 6 to 20 carbon atoms, and especially preferably a bifunctional (meth)acrylate compound having a linear alkylene group with from 6 to 20 carbon atoms in terms of a reduction in the occurrence of a white spot and fading in an image to be formed and fixability.

The copolymerization ratio of the cross-linkable monomer to all of the monomers (cross-linkable monomer/all of the monomers on a mass basis) is not particularly limited but suitably from 2/1,000 to 20/1,000.

The styrene-acrylic resin has a glass transition temperature (Tg) ranging preferably from 40° C. to 75° C., and more preferably from 50° C. to 65° C. in terms of fixability.

The glass transition temperature is determined from a DSC curve obtained by differential scanning calorimetry (DSC) and can be specifically determined in accordance with "Extrapolated Starting Temperature of Glass Transition" described in determination of glass transition temperature in JIS K 7121-1987 "Testing Methods for Transition Temperatures of Plastics".

The weight average molecular weight of the styrene-acrylic resin is preferably from 5,000 to 200,000, more preferably from 10,000 to 100,000, and especially preferably from 20,000 to 80,000 in terms of storage stability.

The styrene-acrylic resin can be produced by any method; and a variety of polymerization methods (such as solution polymerization, precipitation polymerization, suspension polymerization, bulk polymerization, and emulsion polymerization) can be used. The polymerization reaction can be any of known polymerization (such as batch polymerization, semi-continuous polymerization, and continuous polymerization).

Polyester Resin

The binder resin is suitably a polyester resin.

Examples of the polyester resin include known amorphous polyester resins. The polyester resin may be a combination of the amorphous polyester resin and a crystalline polyester resin. The amount of the crystalline polyester resin may be in the range of 2 mass % to 40 mass % (suitably from 2 mass % to 20 mass %) relative to the whole binder resin.

The "crystallinity" of a resin refers to that the resin does not have a stepwise change in the amount of heat absorption but have a definite endothermic peak in the differential scanning calorimetry (DSC). Specifically, it refers to that the half-value width of the endothermic peak in the measurement at a rate of temperature increase of 10 (° C./min) is within 10° C.

The "amorphous properties" of a resin refers to that the half-value width of the endothermic peak exceeds 10° C., that a stepwise change in the amount of heat absorption is exhibited, or that definite endothermic peak is not observed.

Amorphous Polyester Resin

Examples of the amorphous polyester resin include polycondensates of a polycarboxylic acid with a polyhydric alcohol. The amorphous polyester resin may be a commercially available product or may be a synthesized resin.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid); alicyclic dicarboxylic acids (such as cyclohexanedicarboxylic acid); aromatic dicarboxylic acids (such as terephthalic acid, isophthalic acid, phthalic acid, and naphthalenedicarboxylic acid); anhydrides of the foregoing; and lower alkyl esters (having, for example, from 1 to 5 carbon atoms) of the foregoing. Of these, for example, aromatic dicarboxylic acids are suitable as the polycarboxylic acid.

The polycarboxylic acid may be a combination of the dicarboxylic acid with a carboxylic acid that has three or more carboxy groups and that gives a cross-linked structure or a branched structure. Examples of the carboxylic acid having three or more carboxy groups include trimellitic acid and pyromellitic acid, anhydrides of the foregoing, and lower alkyl esters (having, for example, from 1 to 5 carbon atoms) of the foregoing.

Such polycarboxylic acids may be used alone or in combination.

Examples of the polyhydric alcohol include aliphatic diols (such as ethylene glycol, diethylene glycol, triethylene glycol, propylene glycol, butanediol, hexanediol, and neopentyl glycol); alicyclic diols (such as cyclohexanediol, cyclohexanedimethanol, and hydrogenated bisphenol A); and aromatic diols (such as ethylene oxide adducts of bisphenol A and propylene oxide adducts of bisphenol A). Among these, for example, aromatic diols and alicyclic diols are preferred as the polyhydric alcohol, and aromatic diols are more preferred.

The polyhydric alcohol may be a combination of the diol with a polyhydric alcohol that has three or more hydroxy groups and that gives a cross-linked structure or a branched structure. Examples of the polyhydric alcohol having three or more hydroxy groups include glycerin, trimethylolpropane, and pentaerythritol.

Such polyhydric alcohols may be used alone or in combination.

The amorphous polyester resin has a glass transition temperature (Tg) ranging preferably from 50° C. to 80° C., and more preferably from 50° C. to 65° C.

The glass transition temperature is determined from a DSC curve obtained by differential scanning calorimetry (DSC) and can be specifically determined in accordance with "Extrapolated Starting Temperature of Glass Transition" described in determination of glass transition temperature in JIS K 7121-1987 "Testing Methods for Transition Temperatures of Plastics".

The amorphous polyester resin has a weight average molecular weight (Mw) ranging preferably from 5000 to 1000000, and more preferably from 7000 to 500000.

The amorphous polyester resin suitably has a number average molecular weight (Mn) ranging from 2000 to 100000.

The amorphous polyester resin has a molecular weight distribution Mw/Mn ranging preferably from 1.5 to 100, and more preferably from 2 to 60.

The weight average molecular weight and number average molecular weight are measured by gel permeation chromatography (GPC). The measurement of the molecular weight by GPC involves using a measurement apparatus that is GPC·HLC-8120GPC manufactured by Tosoh Corporation, a column that is TSK gel Super HM-M (15 cm) manufactured by Tosoh Corporation, and a tetrahydrofuran (THF) solvent. From results of such measurement, the weight average molecular weight and the number average molecular weight are calculated from a molecular weight calibration curve plotted on the basis of a standard sample of monodisperse polystyrene.

The amorphous polyester resin can be produced by any of known techniques. In particular, the amorphous polyester resin is, for example, produced through a reaction at a polymerization temperature ranging from 180° C. to 230° C. optionally under reduced pressure in the reaction system, while water or alcohol that is generated in condensation is removed.

In the case where monomers as the raw materials are not dissolved or compatible at the reaction temperature, a solvent having a high boiling point may be used as a solubilizing agent in order to dissolve the raw materials. In such a case, the polycondensation reaction is performed while the solubilizing agent is distilled away. In the case where monomers having low compatibility are used in the copolymerization reaction, such monomers are preliminarily subjected to condensation with an acid or alcohol that is to undergo polycondensation with the monomers, and then the resulting product is subjected to polycondensation with the principle components.

Crystalline Polyester Resin

Examples of the crystalline polyester resin include polycondensates of a polycarboxylic acid with a polyhydric alcohol. The crystalline polyester resin may be a commercially available product or a synthesized resin.

The crystalline polyester resin may be suitably a polycondensate prepared from polymerizable monomers having linear aliphatics rather than a polycondensate prepared from polymerizable monomers having aromatics in terms of easy formation of a crystal structure.

Examples of the polycarboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid); aromatic dicarboxylic acids (e.g., dibasic acids such as phthalic acid, isophthalic acid, terephthalic acid, and naphthalene-2,6-dicarboxylic acid); anhydrides of these dicarboxylic acids; and lower alkyl esters (having, for example, from 1 to 5 carbon atoms) of these dicarboxylic acids.

The polycarboxylic acid may be a combination of the dicarboxylic acid with a carboxylic acid that has three or more carboxy groups and that gives a cross-linked structure or a branched structure. Examples of the carboxylic acid having three carboxy groups include aromatic carboxylic acids (such as 1,2,3-benzenetricarboxylic acid, 1,2,4-benzenetricarboxylic acid, and 1,2,4-naphthalenetricarboxylic acid); anhydrides of these tricarboxylic acids; and lower alkyl esters (having, for example, from 1 to 5 carbon atoms) of these tricarboxylic acids.

The polycarboxylic acid may be a combination of these dicarboxylic acids with a dicarboxylic acid having a sulfonic group or a dicarboxylic acid having an ethylenic double bond.

The polycarboxylic acids may be used alone or in combination.

Examples of the polyhydric alcohol include aliphatic diols (such as linear aliphatic diols having a backbone with from 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol are suitable.

The polyhydric alcohol may be a combination of the diol with an alcohol that has three or more hydroxy groups and that gives a cross-linked structure or a branched structure. Examples of the alcohol having three or more hydroxy groups include glycerin, trimethylolethane, trimethylolpropane, and pentaerythritol.

The polyhydric alcohols may be used alone or in combination.

The aliphatic diol content in the polyhydric alcohol may be 80 mol % or more, and suitably 90 mol % or more.

The melting temperature of the crystalline polyester resin is preferably from 50° C. to 100° C., more preferably from 55° C. to 90° C., and further preferably from 60° C. to 85° C.

The melting temperature is determined from a DSC curve obtained by differential scanning calorimetry (DSC) in accordance with "Melting Peak Temperature" described in determination of melting temperature in JIS K 7121-1987 "Testing Methods for Transition Temperatures of Plastics".

The weight average molecular weight (Mw) of the crystalline polyester resin is suitably from 6,000 to 35,000.

The crystalline polyester resin can be, for example, produced by any of known techniques as in production of the amorphous polyester resin.

The amount of the binder resin is, for instance, preferably from 40 mass % to 95 mass %, more preferably from 50 mass % to 90 mass %, and further preferably from 60 mass % to 85 mass % relative to the whole toner particles.

In the case where the toner particles are white toner particles, the amount of the binder resin is preferably from 30 mass % to 85 mass %, and more preferably from 40 mass % to 60 mass % relative to the whole white toner particles.

Colorant

Examples of the colorant include a variety of pigments, such as carbon black, chrome yellow, Hansa Yellow, benzidine yellow, indanthrene yellow, quinoline yellow, pigment yellow, permanent orange GTR, pyrazolone Orange, Vulcan Orange, Watchung Red, Permanent Red, Brilliant Carmine 3B, Brilliant Carmine 6B, Du Pont Oil Red, pyrazolone red, lithol red, rhodamine B lake, lake red C, pigment red, rose bengal, aniline blue, ultramarine blue, chalco oil blue, methylene blue chloride, phthalocyanine blue, pigment blue, phthalocyanine green, malachite green oxalate, titanium oxide, zinc oxide, calcium carbonate, basic lead carbonate, zinc sulfide-barium sulfate mixtures, zinc sulfide, silicon dioxide, and aluminum oxide, and a variety of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

In the case where the toner particles are white toner particles, the colorant can be a white pigment.

The white pigment is preferably titanium oxide or zinc oxide, and more preferably titanium oxide.

The colorants may be used alone or in combination.

The colorant may be optionally a surface-treated colorant or may be used in combination with a dispersant.

Different types of colorant may be used in combination.

The amount of the colorant is, for instance, preferably from 1 mass % to 30 mass %, and more preferably from 3 mass % to 15 mass % relative to the whole toner particles.

In the case where the toner particles are white toner particles, the amount of the white pigment is preferably from 15 mass % to 70 mass %, and more preferably from 20 mass % to 60 mass % relative to the whole white toner particles.

Release Agent Examples of the release gent include, but are not limited to, hydrocarbon waxes; natural waxes such as a carnauba wax, a rice bran wax, and a candelilla wax; synthetic or mineral/petroleum waxes such as a montan wax; and ester waxes such as a fatty acid ester and a montanic acid ester.

The melting temperature of the release agent is preferably form 50° C. to 110° C., more preferably from 70° C. to 100° C., further preferably from 75° C. to 95° C., and especially preferably from 83° C. to 93° C. in terms of a reduction in the occurrence of a white spot and fading in an image that is to be formed.

The melting temperature is determined from a DSC curve obtained by differential scanning calorimetry (DSC) in accordance with "Melting Peak Temperature" described in determination of melting temperature in JIS K 7121-1987 "Testing Methods for Transition Temperatures of Plastics".

In the toner particles of the specific toner, when the number of the release agent particles with an aspect ratio of 5 or more in the toner is defined as "a" and the number of the release agent particles with an aspect ratio of less than 5 is defined as "b", the relationship thereof is preferably $1.0<a/b<8.0$, more preferably $2.0<a/b<7.0$, and especially preferably $3.0<a/b<6.0$ in terms of a reduction in the occurrence of a white spot and fading in an image that is to be formed.

In the toner particles of the specific toner, when the area of the release agent particles with an aspect ratio of 5 or more in the toner is defined as "c" and the area of the release agent particles with an aspect ratio of less than 5 is defined as "d", the relationship thereof is preferably $1.0<c/d<4.0$, more preferably $1.5<c/d<3.5$, and especially preferably $2.0<c/d<3.0$ in terms of a reduction in the occurrence of a white spot and fading in an image that is to be formed.

The aspect ratio of the release agent in the toner is measured as follows.

The toner is mixed with an epoxy resin, and the epoxy resin is solidified. The solidified product is cut with an ultramicrotome apparatus (ULTRACUT UCT manufactured by Leica Microsystems) to produce a thin sample having a thickness ranging from 80 nm to 130 nm. The thin sample is dyed with ruthenium tetroxide in a desiccator at 30° C. for 3 hours. The dyed thin sample is observed with an ultrahigh-resolution field-emission scanning electron microscope (FE-SEM, such as S-4800 manufactured by Hitachi High-Technologies Corporation) to obtain an SEM image. Since release agents are generally more easily dyed with ruthenium tetroxide than binder resins, the release agents can be recognized on the basis of a difference in color density attributed to the degree of the dying. In the case where the difference in color density is hard to be recognized because of, for example, the conditions of the sample, the duration of the dying is adjusted. The colorant domain is generally smaller than the release agent domain on the cross section of the toner particles, and thus these domains can be distinguished from each other on the basis of their sizes.

From the SEM image having various sizes of cross sections of toner particles, the cross sections of toner particles having a diameter that is 85% or more of the volume average particle size of the toner particles are selected; from the selected cross sections, the cross sections of 100 toner particles are further arbitrarily selected and observed. The term "size of the cross section of a toner particle" refers to the maximum length between any two points on the outline of the cross section of the toner particle (namely, longer diameter).

The cross sections of the selected 100 toner particles on the SEM image are each subjected to an image analysis with an image analyzing software (WINROOF manufactured by MITANI CORPORATION) at 0.010000 μm/pixel. In this image analysis, the image of the cross sections of the toner particles can be observed on the basis of the difference in brightness between the epoxy resin mixed with the toner and the binder resin used in the toner particles (contrast). From this observed image, the length of the release agent domain in the toner particles in the long axis direction, the above-mentioned ratio (length in the long axis direction/length in the short axis direction), and the area can be determined.

The aspect ratio of the release agent used in the toner can be controlled, for instance, by growing crystal through maintaining the temperature around the freezing point of the release agent for a given length of time in a cooling process or by promoting crystal growth in a cooling process through using two or more release agents having different melting temperatures.

The amount of the release agent is, for example, preferably from 1 mass % to 20 mass %, and more preferably from 5 mass % to 15 mass % relative to the amount of the whole toner particles.

Other Additives

Examples of other additives include known additives such as a magnetic material, a charge-controlling agent, and inorganic powder. These additives are contained in the toner particles as internal additives.

Characteristics of Toner Particles

The toner particles may have a monolayer structure or may have a core shell structure including a core (core particle) and a coating layer (shell layer) that covers the core.

The toner particles having a core shell structure, for instance, properly include a core containing the binder resin and optionally an additive, such as a colorant or a release agent, and a coating layer containing the binder resin.

The volume average particle size (D50v) of the toner particles is preferably from 2 μm to 10 μm, and more preferably from 4 μm to 8 μm.

The volume average particle size of the toner particles is measured with COULTER MULTISIZER II (manufactured by Beckman Coulter, Inc.) and an electrolyte that is ISOTON-II (manufactured by Beckman Coulter, Inc.).

In the measurement, from 0.5 mg to 50 mg of a test sample is added to 2 ml of a 5-mass % aqueous solution of a surfactant (suitably sodium alkylbenzene sulfonate) as a dispersant. This product is added to from 100 ml to 150 ml of the electrolyte.

The electrolyte suspended with the sample is subjected to dispersion for 1 minute with an ultrasonic disperser and then subjected to the measurement of the particle size distribution of particles having a particle size ranging from 2 μm to 60 μm using COULTER MULTISIZER II with an aperture having an aperture diameter of 100 μm. The number of sampled particles is 50,000.

Cumulative distributions by volume are drawn from the smaller diameter side in particle size ranges (channels) into which the measured particle size distribution is divided. The particle size for a cumulative percentage of 50% is defined as a volume average particle size D50v.

The average circularity of the toner particles is not particularly limited; in order to make the toner well removable from the image holding member, the average circularity is preferably from 0.91 to 0.98, more preferably from 0.94 to 0.98, and further preferably from 0.95 to 0.97.

The average circularity of the toner particles is determined from (circle-equivalent circumference)/(circumference) [circumference of circle having the same projection area as image of particle]/(circumference of projection image of particle)]. In particular, the average circularity of the toner particles is determined as follows.

The toner particles that are to be analyzed are collected by being sucked and allowed to flow in a flat stream. An image of the particles is taken as a still image by instant emission of stroboscopic light and then analyzed with a flow particle image analyzer (FPIA-3000 manufactured by SYSMEX CORPORATION). The number of samples used to determine the average circularity is 3500.

In the case where the toner contains an external additive, the toner (developer) to be analyzed is dispersed in water containing a surfactant and then subjected to an ultrasonic treatment to obtain toner particles having no external additive content.

In the case where the toner particles are produced by an aggregation coalescence method, the average circularity of the toner particles can be controlled, for example, by adjusting the rate at which a dispersion liquid is stirred, the temperature of the dispersion liquid, and retention time in fusion and coalescence.

External Additives

Examples of external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles as an external additive may be hydrophobized. The hydrophobization is performed by, for example, immersing the inorganic particles in a hydrophobizing agent. The hydrophobizing agent is not particularly limited; and examples thereof include silane coupling agents, silicone oils, titanate coupling agents, and aluminum coupling agents. These may be used alone or in combination.

The amount of the hydrophobizing agent is, for instance, generally from 1 part by mass to 10 parts by mass relative to 100 parts by mass of the inorganic particles.

Examples of the external additives also include resin particles [resin particles such as polystyrene particles, polymethyl methacrylate (PMMA) particles, and melamine resin particles] and cleaning aids (for instance, metal salts of higher fatty acids, such as zinc stearate, and particles of a high molecular weight fluorine material).

The amount of the external additive to be used is, for example, preferably from 0.01 mass % to 10 mass %, and more preferably from 0.01 mass % to 6 mass % relative to the amount of the toner particles.

Production of Toner

Production of the specific toner will now be described.

The specific toner can be produced by preparing toner particles and then externally adding an external additive to the toner particles.

The toner particles may be produced by any of a dry process (such as a kneading pulverizing method) and a wet process (such as an aggregation coalescence method, a suspension polymerization method, or a dissolution suspension method). Production of the toner particles is not particularly limited to these production processes, and any of known techniques can be employed.

In particular, the toner particles are suitably produced by an aggregation coalescence method.

Specifically, for example, production of the toner particles by an aggregation coalescence method include the following processes:

preparing a dispersion liquid of resin particles in which resin particles as the binder resin have been dispersed (preparation of dispersion liquid of resin particles), aggregating the resin particles (optionally with other particles) in the dispersion liquid of resin particles (dispersion liquid optionally mixed with a dispersion liquid of other particles) to form an aggregated particles (formation of aggregated particles), and heating a dispersion liquid of aggregated particles in which the aggregated particles have been dispersed to fuse and coalesce the aggregated particles into toner particles (fusion and coalescence).

Each of the processes will now be described in detail.

In the following description, a method for producing the toner particles containing a colorant and a release agent will be explained; however, use of the colorant and the release agent is optional. Additives other than the colorant and the release agent may be obviously used.

Preparation of Dispersion Liquid of Resin Particles

The dispersion liquid of resin particles in which resin particles as a binder resin have been dispersed as well as, for example, a dispersion liquid of colorant particles in which colorant particles have been dispersed and a dispersion liquid of release agent particles in which release agent particles have been dispersed are prepared.

The dispersion liquid of the resin particles is, for example, prepared by dispersing the resin particles in a dispersion medium with a surfactant.

Examples of the dispersion medium used in the dispersion liquid of resin particles include aqueous media.

Examples of the aqueous media include water, such as distilled water and ion exchanged water, and alcohols. These aqueous media may be used alone or in combination.

Examples of the surfactant include anionic surfactants such as sulfuric acid ester salts, sulfonic acid salts, phosphoric acid esters, and soaps; cationic surfactants such as amine salts and quaternary ammonium salts; and nonionic surfactants such as polyethylene glycol, alkylphenol-ethylene oxide adducts and polyols. Among these surfactants, anionic surfactants and cationic surfactants may be used. Nonionic surfactants may be used in combination with anionic surfactants or cationic surfactants.

The surfactants may be used alone or in combination.

In the dispersion liquid of resin particles, the resin particles can be dispersed in the dispersion medium by any of known dispersion techniques; for example, general dispersers can be used, such as rotary shearing homogenizers or those having media, e.g., a ball mill, a sand mill, and a DYNO mill. Depending on the type of resin particles, the resin particles may be, for instance, dispersed in the dispersion liquid of resin particles by phase inversion emulsification.

In the phase inversion emulsification, a resin to be dispersed is dissolved in a hydrophobic organic solvent in which the resin can be dissolved, a base is added to an organic continuous phase (O phase) for neutralization, and then an aqueous medium (W phase) is added thereto to turn the phase to a discontinuous phase by the conversion of the resin (namely, phase inversion) from W/O to O/W, thereby dispersing the resin in the aqueous medium in the form of particles.

The volume average particle size of the resin particles to be dispersed in the dispersion liquid of resin particles is, for example, preferably from 0.01 μm to 1 μm, more preferably from 0.08 μm to 0.8 μm, and further preferably from 0.1 μm to 0.6 μm.

The volume average particle size of the resin particles is determined as follows. Particle size distribution is measured with a laser-diffraction particle size distribution analyzer (such as LA-700 manufactured by HORIBA, Ltd.), cumulative distribution by volume is drawn from the smaller particle size side in particle size ranges (channels) into which the measured particle size distribution is divided, and the particle size having a cumulative percentage of 50% relative to the whole particles is determined as the volume average particle size D50v. The volume average particle size of the particles in other dispersion liquids is similarly determined.

The amount of the resin particles contained in the dispersion liquid of resin particles is, for example, preferably from 5 mass % to 50 mass %, and more preferably from 10 mass % to 40 mass %.

The dispersion liquid of colorant particles and the dispersion liquid of release agent particles are, for instance, prepared in the same manner as the preparation of the dispersion liquid of resin particles. Accordingly, the volume average particle size of the particles, the dispersion medium, the dispersion method, and the amount of the particles in the dispersion liquid of resin particles are the same as those of the colorant particles dispersed in the dispersion liquid of colorant particles and the release agent particles dispersed in the dispersion liquid of release agent particles.

Formation of Aggregated Particles

The dispersion liquid of resin particles is mixed with the dispersion liquid of colorant particles and the dispersion liquid of release agent particles.

The resin particles, the colorant particles, and the release agent particles are hetero-aggregated in the mixed dispersion liquid to form aggregated particles having a diameter close to the intended diameter of the toner particles and containing the resin particles, the colorant particles, and the release agent particles.

Specifically, for example, an aggregating agent is added to the mixed dispersion liquid, and the pH of the mixed dispersion liquid is adjusted to be acidic (e.g., pH from 2 to 5). Then, a dispersion stabilizer is optionally added thereto, the resulting mixture is heated to a temperature near the glass transition temperature of the resin particles (in particular, for example, −30° C. or more and −10° C. or less of the glass transition temperature of the resin particles), and the particles dispersed in the mixed dispersion liquid are aggregated, thereby forming the aggregated particles.

In the formation of the aggregated particles, for instance, the aggregating agent may be added to the mixed dispersion liquid at room temperature (for instance, 25° C.) under stirring with a rotary shearing homogenizer, the pH of the mixed dispersion liquid may be adjusted to be acidic (e.g., pH from 2 to 5), a dispersion stabilizer may be optionally added thereto, and the resulting mixture may be heated.

Examples of the aggregating agent include surfactants having an opposite polarity to the surfactant used as a dispersant that is to be added to the mixed dispersion liquid, such as inorganic metal salts and di- or higher valent metal complexes. In the case where a metal complex is used as the aggregating agent, the surfactant can be used in a reduced amount, and charging properties can be improved.

An additive that forms a complex or a similar bond with the metal ions of the aggregating agent may be optionally used. Such an additive is suitably a chelating agent.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of the chelating agent include oxycarboxylic acids such as tartaric acid, citric acid, and gluconic acid; iminodiacetic acid (IDA); nitrilotriacetic acid (NTA); and ethylenediaminetetraacetic acid (EDTA).

The amount of the chelating agent is, for example, preferably from 0.01 part by mass to 5.0 parts by mass, more preferably 0.1 part by mass or more and less than 3.0 parts by mass relative to 100 parts by mass of the resin particles.

Fusion and Coalescence

The dispersion liquid of aggregated particles in which the aggregated particles have been dispersed is, for example, heated to the glass transition temperatures or more of the resin particles (such as from 10° C. to 30° C. higher than the glass transition temperatures of the resin particles) to fuse and coalesce the aggregated particles, thereby forming the toner particles.

Alternatively, the dispersion liquid may be heated to the melting temperature or higher of the release agent to fuse and coalesce the aggregated particles, thereby forming the toner particles. In the fusion and coalescence, the resin and the release agent are in a fused state at a temperature that is the glass transition temperature or higher of the resin particles and the melting temperature or higher of the release agent. Then, the fused product is cooled to obtain the toner.

The aspect ratio of the release agent used in the toner can be controlled, for instance, by growing crystal through maintaining the temperature around the freezing point of the release agent for a given length of time in a cooling process or by promoting crystal growth in a cooling process through using two or more release agents having different melting temperatures.

Through the above-mentioned processes, the toner particles are produced.

The method for forming the toner particles may have the following additional processes: after the dispersion liquid of aggregated particles in which the aggregated particles have been dispersed is obtained, the dispersion liquid of aggregated particles is further mixed with a dispersion liquid of resin particles in which the resin particles have been dispersed, and the particles are aggregated such that the resin particles further adhere to the surfaces of the aggregated particles to produce second aggregated particles; and a dispersion liquid of second aggregated particles in which the second aggregated particles have been dispersed is heated to fuse and coalesce the second aggregated particles, thereby producing toner particles having a core shell structure.

After the fusion and coalescence, the toner particles formed in the solution are washed, subjected to solid-liquid separation, and dried by known techniques to yield dried toner particles.

The washing may be sufficiently carried out by displacement washing with ion exchanged water in terms of charging properties. The solid-liquid separation is not particularly limited but may be suction filtration or pressure filtration in terms of productivity. The drying is not particularly limited but may be freeze drying, flush drying, fluidized drying, or vibratory fluidized drying in terms of productivity.

An external additive is, for instance, added to the produced toner particles that are in a dried state, and the resulting toner particles are mixed to produce the specific toner. The mixing may be performed, for example, with a V-blender, a HENSCHEL MIXER, or a LOEDIGE MIXER. The coarse particles of the toner may be optionally removed with a vibrating sieve, an air sieve, or another device.

Carrier

The carrier is not particularly limited, and any of known carriers can be used. Examples of the carrier include coated carriers in which the surface of a core formed of magnetic powder has been coated with a coating resin, magnetic powder dispersed carriers in which magnetic powder has been dispersed in or blended with a matrix resin, and resin impregnated carriers in which porous magnetic powder has been impregnated with resin.

In the magnetic powder dispersed carriers and the resin impregnated carriers, the constituent particles may have a surface coated with a coating resin.

Examples of the magnetic powder include magnetic metals, such as iron, nickel, and cobalt, and magnetic oxides such as ferrite and magnetite.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing an organosiloxane bond or a modified product thereof, fluororesins, polyester, polycarbonate, phenol resins, and epoxy resins.

The coating resin and the matrix resin may contain other additives such as conductive particles.

Examples of the conductive particles include particles of metals such as gold, silver, and copper; carbon black particles; titanium oxide particles; zinc oxide particles; tin oxide particles; barium sulfate particles; aluminum borate particles; and potassium titanate particles.

An example of the preparation of the coated carrier involves coating with a coating layer forming solution in which the coating resin and optionally a variety of additives have been dissolved in a proper solvent. The solvent is not particularly limited and may be determined in view of, for instance, the type of coating resin to be used and coating suitability.

Specific examples of the coating method include a dipping method of dipping the core into the coating layer forming solution, a spray method of spraying the coating layer forming solution onto the surface of the core, a fluid-bed method of spraying the coating layer forming solution to the core that is in a state of being floated by the flowing air, and a kneader coating method of mixing the core of the carrier with the coating layer forming solution in the kneader coater and removing a solvent.

The mixing ratio (mass ratio) of the toner to the carrier in the two-component developer (toner:carrier) is preferably from 1:100 to 30:100, and more preferably from 3:100 to 20:100.

Structure of Image Forming Apparatus

The structure of the image forming apparatus according to the exemplary embodiment will now be described with reference to the drawings.

The image forming apparatus according to the exemplary embodiment includes an image holding member, a charging unit that charges the surface of the image holding member, an electrostatic charge image forming unit that forms an electrostatic charge image on the charged surface of the image holding member, a developing unit that includes an electrostatic charge image developer and that develops the electrostatic charge image on the surface of the image holding member with the electrostatic charge image developer to form a toner image, an intermediate transfer body, a first transfer unit that first transfers the toner image on the surface of the image holding member to the surface of the intermediate transfer body, and a second transfer unit that second transfers the toner image transferred to the surface of the intermediate transfer body to a recording medium. The image forming apparatus may further include a fixing unit that fixes the toner image transferred to the surface of the recording medium.

The electrostatic charge image developer may be an electrostatic charge image developer containing the specific toner.

The image forming apparatus according to the exemplary embodiment carries out an image forming process that includes charging the surface of the image holding member, forming an electrostatic charge image on the charged surface of the image holding member, developing the electrostatic charge image on the surface of the image holding member with an electrostatic charge image developer containing the specific toner to form a toner image, first transferring the toner image on the surface of the image holding member to the surface of the intermediate transfer body, and second transferring the toner image transferred to the surface of the intermediate transfer body to a recording medium. This image forming process may further includes fixing the toner image transferred to the surface of a recording medium.

The image forming apparatus according to the exemplary embodiment may be any of known image forming apparatuses such as an apparatus which has a cleaning unit that cleans the surface of the image holding member after the transfer of a toner image and before the charging and an apparatus which has an erasing unit that irradiates light to the surface of the image holding member to remove charges after the transfer of the toner image and before charging.

In the structure of the image forming apparatus according to the exemplary embodiment, for instance, the part including the developing unit may be in the form of a cartridge that is removably attached to the image forming apparatus (process cartridge). The suitable process cartridge is, for example, a process cartridge that includes the developing unit including an electrostatic charge image developer containing the specific toner.

An example of the image forming apparatus according to the exemplary embodiment will now be described, but the image forming apparatus according to the exemplary embodiment is not limited thereto. Only the parts illustrated in the drawings will be described, and description of the other parts is omitted.

FIG. 1 schematically illustrates the structure of the image forming apparatus according to the exemplary embodiment.

The image forming apparatus illustrated in FIG. 1 includes first to fourth electrophotographic image forming units 10Y, 10M, 10C and 10K (image forming units) that output yellow (Y), magenta (M), cyan (C) and black (K) color images, respectively, on the basis of image data separately corresponding to these colors. These image forming units (also simply referred to as "units) 10Y, 10M, 10C and 10K are horizontally disposed in parallel so as to be spaced apart from each other at predetermined intervals. Each of the units 10Y, 10M, 10C and 10K may be a process cartridge that is detachably provided to the body of the image forming apparatus.

An intermediate transfer belt 20 as an intermediate transfer body extends so as to overlie the units 10Y, 10M, 10C, and 10K in the drawing and runs through the individual units. The intermediate transfer belt 20 is wound around a driving roller 22 and support roller 24 that are spaced apart from each other in the lateral direction in the drawing and runs in the direction from the first unit 10Y to the fourth unit 10K, the support roller 24 being in contact with the inner surface of the intermediate transfer belt 20. The support roller 24 receives force applied by a spring or another member (not illustrated) in the opposite direction to the driving roller 22, so that the intermediate transfer belt 20 wound around these rollers is under tension. An intermediate transfer body cleaning device 30 is provided on the intermediate transfer belt 20 on the side of the image holding member so as to face the driving roller 22.

Toners including four color toners of yellow, magenta, cyan, and black accommodated in toner cartridges 8Y, 8M, 8C, and 8K are supplied to developing devices (developing units) 4Y, 4M, 4C, and 4K of the units 10Y, 10M, 10C, and 10K, respectively.

Since each of the first to fourth units 10Y, 10M, 10C, and 10K has the same structure, the first unit 10Y that is disposed on the upstream side in the rotational direction of the intermediate transfer belt to form yellow images is herein described as a representative example of the image forming unit. The components of the second to fourth units 10M, 10C and 10K that are equivalent to those of the first unit 10Y are denoted by reference symbols having the characters M for magenta, C for cyan, and K for black, respectively, as in the components of the first unit 10Y denoted by reference symbols having the character Y for yellow, thereby omitting description of the second to fourth units 10M, 10C and 10K.

The first unit 10Y includes a photoreceptor 1Y that serves as an image holding member. The first unit 10Y has the following constituents provided around the photoreceptor 1Y in this order: a charging roller 2Y which charges the surface of the photoreceptor 1Y to a predetermined electric potential (example of the charging unit), an exposure device 3 in which the charged surface is exposed to a laser beam 3Y on the basis of image signals separately corresponding to different colors to form an electrostatic charge image (example of the electrostatic charge image forming unit), a developing device 4Y which supplies charged toner to the electrostatic charge image to develop the electrostatic charge image (example of the developing unit), a first transfer roller 5Y which transfers the developed toner image onto the intermediate transfer belt 20 (example of the first transfer unit), and a photoreceptor cleaning device 6Y which removes the toner remaining on the surface of the photoreceptor 1Y after the first transfer (example of the cleaning unit).

The first transfer roller 5Y is disposed inside the intermediate transfer belt 20 so as to face the photoreceptor 1Y. The first transfer rollers 5Y, 5M, 5C, and 5K are individually connected to bias supplies (not illustrated) used for applying a first transfer bias. The bias supplies are controlled by a controller (not illustrated) to adjust the transfer bias to be applied to the corresponding first transfer roller.

A process for forming yellow images with the first unit 10Y will now be described.

In advance of the process, the surface of the photoreceptor 1Y is charged to an electric potential ranging from −600 V to −800 V with the charging roller 2Y.

The photoreceptor 1Y has a conductive substrate (for example, volume resistivity at 20° C.: $1\times10^{-6}$ Ωcm or less) and a photosensitive layer formed thereon. The photosensitive layer normally has a high resistance (resistance of general resins); in the case where the photosensitive layer is irradiated with the laser beam 3Y, the specific resistance of the part irradiated with the laser beam changes. The laser beam 3Y is emitted from the exposure device 3 to the charged surface of the photoreceptor 1Y on the basis of image data for yellow that has been transmitted from a controller (not illustrated). The laser beam 3Y is radiated to the photosensitive layer that is the surface of the photoreceptor 1Y, so that an electrostatic charge image of a yellow image pattern is formed on the surface of the photoreceptor 1Y.

The electrostatic charge image herein refers to an image formed on the surface of the photoreceptor 1Y owing to charging and is a so-called negative latent image formed as follows: part of the photosensitive layer is irradiated with the laser beam 3Y to decrease the specific resistance thereof, and this causes the release of electric charges on the charged surface of the photoreceptor 1Y whereas electric charges remain in another part not irradiated with the laser beam 3Y.

The electrostatic charge image formed on the photoreceptor 1Y is carried to a predetermined developing position by the rotation of the photoreceptor 1Y. The electrostatic charge image on the photoreceptor 1Y is developed into a visible image (developed image) as a toner image at this developing position by the developing device 4Y.

The developing device 4Y, for instance, contains an electrostatic charge image developer containing at least a yellow toner and a carrier. The yellow toner is agitated in the developing device 4Y for frictional charging, has electric charges exhibiting the same polarity (negative polarity) as the electric charges on the charged photoreceptor 1Y, and is held on a developer roller (example of a developer holding member). The surface of the photoreceptor 1Y passes through the developing device 4Y, so that the yellow toner electrostatically adheres to a latent image part, from which electric charges have been released, on the surface of the photoreceptor 1Y; thus, the latent image is developed with the yellow toner. The photoreceptor 1Y on which the yellow toner image has been formed continues to rotate at a predetermined speed, and the toner image developed on the photoreceptor 1Y is conveyed to a predetermined first transfer position.

When the yellow toner image on the photoreceptor 1Y is conveyed to the first transfer, a first transfer bias is applied to the first transfer roller 5Y, and an electrostatic force directed from the photoreceptor 1Y toward the first transfer roller 5Y acts on the toner image, so that the toner image on the photoreceptor 1Y is transferred onto the intermediate transfer belt 20. In this case, the transfer bias to be applied has a polarity (positive) opposite to that of the toner (negative polarity); for instance, the bias is controlled to +10 μA by a controller (not illustrated) in the first image forming unit 10Y.

Meanwhile, the toner remaining on the photoreceptor 1Y is removed by the photoreceptor cleaning device 6Y and then recovered.

First transfer biases to be applied to the first transfer roller 5M of the second unit 10M and the other first transfer rollers 5C and 5K are controlled as in the first unit 10Y.

In this manner, the part of the intermediate transfer belt 20 to which the yellow toner image has been transferred by the first unit 10Y successively passes through the second to fourth units 10M, 10C and 10K, and toner images of respective colors are superimposed and multi-transferred.

The four-color toner images that have been multi-transferred to the intermediate transfer belt 20 through the first to fourth units are conveyed to a second transfer part that includes the intermediate transfer belt 20, the support roller 24 being in contact with the inner surface of the intermediate transfer belt 20, and the second transfer roller 26 (example of the second transfer unit) disposed so as to face the image holding side of the intermediate transfer belt 20. The recording paper P (example of the recording medium) is fed with a feeding mechanism at a predetermined timing to a gap at which the second transfer roller 26 is in contact with the intermediate transfer belt 20, and a second transfer bias is applied to the support roller 24. The transfer bias to be applied at this time has a polarity (negative) the same as that of the toner (negative polarity), and an electrostatic force directed from the intermediate transfer belt 20 toward the recording paper P acts on the toner image, so that the toner image on the intermediate transfer belt 20 is transferred onto the recording paper P. In this case, the second transfer bias is determined on the basis of a resistance detected by a resistance detector (not illustrated) used for detecting a resistance of the second transfer part, and its voltage is controlled.

The recording paper P is subsequently transported to the part at which a pair of fixing rollers of a fixing device 28 (example of the fixing unit) are pressed against each other (nip part), thereby fixing the toner image onto the recording paper P to form a fixed image.

Intermediate Transfer Body

The intermediate transfer body included in the image forming apparatus according to the exemplary embodiment will now be described.

The circumferential surface of the intermediate transfer body has a micro rubber hardness ranging from 45 to 65. The micro rubber hardness is preferably from 50 to 65, and more preferably 55 to 60.

When the circumferential surface of the intermediate transfer body has a micro rubber hardness of 65 or less, a nip width is formed at the second transfer part so as to reflect the surface profile of a recording medium, namely reflect whether the surface of the recording medium has unevenness or not (in other words, whether the smoothness of the surface is low or high). Accordingly, even when a recording medium has unevenness (namely, low smoothness), pressure from the intermediate transfer body is well applied to the inside of the recess of the uneven surface profile, so that stable transfer performance can be produced regardless of the type of the recording medium. A micro rubber hardness of 45 or more gives nip stability, which enables excellent second transfer performance.

The micro rubber hardness of the circumferential surface of the intermediate transfer body is measured with a micro durometer (MD-1) manufactured by Kobunshi Keiki Co., Ltd.; in the measurement, a pushing needle is pressed against the circumferential surface of the intermediate transfer body to deform the circumferential surface, and the depth of the needle pressing the surface is measured to determine the hardness on the basis of the measured depth. The pushing needle is a type A having a diameter of 0.16 mm, and the measurement conditions are a temperature of 23° C. and humidity of 50%.

The micro rubber hardness of the intermediate transfer body may be adjusted by any technique. In the case where the intermediate transfer body has, for example, a layered structure in which an elastic layer is on a base layer, the micro hardness can be adjusted by changing the hardness of the elastic layer or by changing the thickness of the elastic layer. The hardness of the elastic layer can be adjusted, for example, by changing the material of the elastic layer, changing the amount of a cross-linking agent used in the elastic layer, or changing the amount of a filler used in the elastic layer.

The intermediate transfer body may have any shape; for example, it can be in the form of an endless belt or another member such as a roller. In the following description, an example in which the intermediate transfer body is in the form of an endless belt member (namely, intermediate transfer belt) and the structure thereof will be explained.

The intermediate transfer belt may be, for instance, a belt member having a layered structure that includes an elastic layer serving as the circumferential surface of the intermediate transfer belt and a substrate disposed on the inner surface of the elastic layer and serving as the inner surface of the intermediate transfer belt. The elastic layer and the substrate may be in direct contact with each other at the interface therebetween; alternatively, another layer, such as an adhesive layer, may be disposed therebetween.

The intermediate transfer belt may be a belt member having a single-layer structure including only the elastic layer.

The individual layers of the intermediate transfer belt will now be described.

Elastic Layer

The elastic layer contains a material having elasticity (elastic material) and suitably contains a rubber material. The elastic layer may contain a conductive agent to gain conductivity; in addition, it may further contain other known additives.

Elastic Material

Examples of the elastic material used in the elastic layer include rubber materials such as an acrylic rubber [e.g., acrylonitrile-butadiene copolymer rubber (NBR)], a urethane rubber, an ethylene-propylene-diene rubber (EPDM), an epichlorohydrin rubber (ECO), a chloroprene rubber (CR), a styrene-butadiene rubber (SBR), a chlorinated polyisoprene rubber, an isoprene rubber, a hydrogenated polybutadiene rubber, a butyl rubber, a silicone rubber, and a fluororubber. In addition to the rubber material, a resin, such as polyurethane, polyethylene, polyamide, or polypropylene, can be used. The elastic materials may be used alone or in combination in the elastic layer.

Among those elastic layers, an acrylic rubber is suitable in terms of a reduction in the occurrence of a white spot and fading and formability of the nip.

Filler

The elastic layer may contain a filler in order to adjust the micro rubber hardness of the circumferential surface of the intermediate transfer body to be within the above-mentioned range. The filler can be either an organic filler or an inorganic filler.

Examples of the organic filler include thermosetting resin particles, such as melamine resin particles, phenol resin particles, epoxy resin particles, urea resin particles, unsaturated polyester resin particles, alkyd resin particles, polyurethane particles, curable polyimide particles, and silicone resin particles, and thermoplastic resin particles, such as vinyl chloride resin particles, polyethylene particles, polypropylene particles, polystyrene particles, polyvinyl acetate particles, TEFLON (registered trademark) particles, ABS resin particles, and acrylic resin particles.

Examples of the inorganic filler include inorganic particles such as carbides (e.g., carbon black, carbon fiber, and carbon nanotube), titanium oxide, silicon carbide, talc, mica, kaoline, iron oxide, calcium carbonate, calcium silicate, magnesium oxide, graphite, silicon nitride, boron nitride, cerium oxide, aluminum oxide, magnesium carbonate, and metallic silicon.

Of these, melamine resin particles are suitable in terms of controlling micro rubber hardness.

The amount of the filler in the elastic layer can be determined on the basis of the intended micro rubber hardness; for instance, it is preferably from 0.1 mass % to 50 mass %, and more preferably from 0.2 mass % to 40 mass % relative to the total mass of the elastic layer.

The fillers may be used alone or in combination.

Conductive Agent

The elastic layer may contain a conductive agent to gain conductivity.

Examples of the conductive agent include conductive particles (for instance, particles having a volume resistivity of less than $10^7$ Ω·cm, the same holds true for the following description) and semiconductive particles (for instance, particles having a volume resistivity ranging from $10^7$ Ω·cm to $10^{13}$ Ω·cm, the same holds true for the following description).

Examples of the conductive agent include, but are not limited to, carbon blacks (such as KETJENBLACK, acetylene black, and carbon black having an oxidized surface); materials involving carbon, such as carbon fibers, carbon nanotubes, and graphite; metals and alloys (such as aluminum, nickel, copper, and silver); metal oxides (such as yttrium oxide, tin oxide, indium oxide, antimony oxide, and $SnO_2$—$In_2O_3$ composite oxide); and ionic conductive materials (such as potassium titanate and LiCl).

The conductive agent is selected on the basis of the intended use. The conductive agent is suitably a carbon black; in terms of temporal stability of electric resistance and electric field dependence that reduces electric field concentration caused by transfer voltage, oxidized carbon black having pH of 5 or less (preferably pH of 4.5 or less, and more preferably pH of 4.0 or less) is suitably used (for example, carbon black produced by introducing a carboxyl group, a quinone group, a lactone group, or a hydroxyl group to the surface thereof).

The average primary particle size of the carbon black is, for example, suitably from 10 nm to 50 nm, and preferably from 15 nm to 30 nm.

The average primary particle size of the conductive agent, such as carbon black, is measured as follows.

The intermediate transfer body to be analyzed is cut with a microtome to obtain a measurement sample having a thickness of 100 nm, and the measurement sample is observed with a transmission electron microscope (TEM). The projected areas of 50 conductive agent particles are determined, and the diameters of circles of which the areas are equal to the individual projected areas are defined as particle sizes; then, the average of the particle sizes is defined as the primary particle size.

The conductive agent content in the elastic layer is determined on the basis of the intended resistance; for example, it is preferably from 20 mass % to 35 mass %, and more preferably from 25 mass % to 30 mass % relative to the total mass of the elastic layer.

The conductive agents may be used alone or in combination.

Other Additives

Examples of additives other than the filler and the conductive agent include dispersants for enhancing the dispersibility of the filler and the conductive agent (such as carbon black); catalysts; leveling agents for enhancing the quality of films to be formed; and releasing materials for improving release properties [such as particles of fluororesin, e.g., polytetrafluoroethylene (PTFE), a tetrafluoroethylene-perfluoroalkyl vinyl ether copolymer (PFA), and a tetrafluoroethylene-hexafluoropropylene copolymer (FEP)].

Thickness of Elastic Layer

In the case where the intermediate transfer body is an intermediate transfer belt having a single-layer structure including only the elastic layer, the thickness (average thickness) of the elastic layer is preferably from 200 μm to 5000 μm, more preferably from 300 μm to 4000 μm, and further preferably from 400 μm to 2000 μm.

The elastic layer (namely, intermediate transfer belt) having such a thickness easily enhances efficiency of the transfer of a toner image from the image holding member to the surface of a recording medium and enables the drive transmission performance of the intermediate transfer belt itself to be readily improved.

In the case where the intermediate transfer body is an intermediate transfer belt having a layered structure in which the substrate is on the inner surface of the elastic layer, the thickness (average thickness) of the elastic layer is preferably from 100 μm to 2000 μm, more preferably from 150 μm to 1500 μm, and further preferably from 200 μm to 1000 μm.

The elastic layer having such a thickness easily enhances efficiency of the transfer of a toner image from the image holding member to the surface of a recording medium.

The thicknesses of the individual layers of the intermediate transfer body are measured with an eddy current type film thickness meter (CTR-1500E manufactured by SANKO ELECTRONIC LABORATORY CO., LTD). In the exemplary embodiment, thickness is measured at 12 points (a row of 3 points spaced apart from each other at regular intervals in the axial direction of the intermediate transfer body and rows of 4 points starting from the individual 3 points and spaced apart from each other at regular intervals in the circumferential direction of the intermediate transfer body), and the average of the measured thicknesses is defined as average thickness.

In the case where the intermediate transfer body is an intermediate transfer belt and wound around multiple rollers under tension, the term "axial direction of the intermediate transfer body" refers to the axial direction of the rollers; in the case where the intermediate transfer body is an intermediate transfer roller, it refers to the axial direction of the intermediate transfer roller.

Substrate

The intermediate transfer body may be an intermediate transfer belt having a layered structure in which the substrate is on the inner surface of the elastic layer.

The substrate, for example, suitably contains a resin material. Furthermore, the substrate may contain a conductive agent to gain conductivity; in addition, it may further contain other known additives.

Resin Material

Examples of the resin material used in the substrate include polyimide resins, fluorinated polyimide resins, polyamide resins, polyamide-imide resins, polyether-ether-ester resins, polyarylate resins, and polyester resins. These resin materials may be used alone or in combination in the substrate.

Among these resin materials, at least either one of polyimide resins and polyamide-imide resins are suitably used in order to enhance the rigidity of the inner surface of the belt member and to thus make the belt member less likely to be deformed when it is put around the multiple rollers under tension.

Filler, Conductive Agent, and Other Additives

The substrate may contain a filler, a conductive agent, and other additives. Examples of the filler, the conductive agent, and other additives include the fillers, conductive agents, and other additives given in the description of the elastic layer.

The conductive agent content in the substrate is determined on the basis of the intended resistance; for example, it is preferably from 1 mass % to 50 mass %, more preferably from 2 mass % to 40 mass %, and further preferably from 4 mass % to 30 mass % relative to the mass of the whole substrate.

The conductive agents may be used alone or in combination.

Thickness of Substrate

In the case where the intermediate transfer body is an intermediate transfer belt having a layered structure in which the substrate is on the inner surface of the elastic layer, the thickness (average thickness) of the substrate is preferably from 10 μm to 1000 μm, more preferably from 30 μm to 600 μm, and further preferably from 50 μm to 400 μm.

Such a thickness of the substrate, which serves as the inner surface of the intermediate transfer belt, enables an easy reduction in a change in tension due to the stretch of the belt, which is wound around multiple rollers, in the rotational driving thereof; thus, the intermediate transfer belt has an excellent drive transmission performance.

Adhesive Layer

In the case where the intermediate transfer body is an intermediate transfer belt having a layered structure in which the substrate is on the inner surface of the elastic layer, an adhesive layer may be disposed between the elastic layer and the substrate. An adhesive used in the adhesive layer can be any of known additives; and examples thereof include silane coupling agents, silicone adhesives, and urethane adhesives.

Characteristics of Intermediate Transfer Body

The common logarithm value of the surface resistivity of the circumferential surface of the intermediate transfer body is preferably from 9 (Log Ω/□) to 13 (Log Ω/□), and more preferably from 10 (Log Ω/□) to 12 (Log Ω/□) in view of transferability.

The common logarithm value of the surface resistivity is controlled, for example, on the basis of the type of a resin to be used and the type and amount of a conductive agent to be used.

The surface resistivity is measured as follows. The surface resistivity is measured with a circular electrode (for example, "UR probe" of HIRESTA IP manufactured by Mitsubishi Petrochemical Co., Ltd.) in accordance with JIS-K6911 (in 1995). The circular electrode includes a first voltage applying electrode and a planar insulator. The first voltage applying electrode includes a columnar electrode part and a cylindrical ring electrode part having an inner diameter larger than the outer diameter of the columnar electrode part and surrounding the columnar electrode part so as to be spaced at regular intervals. A belt is disposed between a set of the columnar electrode part and ring electrode part of the first voltage applying electrode and the planar insulator. A voltage V (V) is applied between the columnar electrode part and ring electrode part of the first voltage applying electrode, and an electric current I (A) flowing at this time is measured. Then, the surface resistivity ρs (Ω/□) of the transfer side of the belt is calculated from the below equation. In the equation, d (mm) refers to the outer diameter of the columnar electrode part, and D (mm) refers to the inner diameter of the ring electrode part.

$$\rho s=\pi\times(D+d)/(D-d)\times(V/I) \quad \text{Equation:}$$

In order to calculate the surface resistivity, a voltage of 500 V is applied for 10 seconds with a circular electrode ("UR probe" of HIRESTA IP manufactured by Mitsubishi Petrochemical Co., Ltd., outer diameter of columnar electrode part: 16 mm, inner diameter of ring electrode part: 30 mm, and outer diameter of ring electrode part: 40 mm) at a temperature of 22° C. and 55% RH, and then the electric current is measured.

The common logarithm value of the volume resistivity of the entire intermediate transfer body is, for instance, suitably from 8 (Log Ω/cm) to 13 (Log Ω/cm) in view of transferability. The common logarithm value of the volume resistivity is controlled on the basis of the type of resin to be used and the type and amount of a conductive agent to be used.

The volume resistivity is measured with a circular electrode (for example, "UR probe" of HIRESTA IP manufactured by Mitsubishi Petrochemical Co., Ltd.) in accordance with JIS-K6911 (in 1995). The same device used for the measurement of the surface resistivity is used for the measurement of the volume resistivity. In the circular electrode, a second voltage applying electrode replaces the planar insulator used for the measurement of the surface resistivity. A belt is disposed between a set of the columnar electrode part and ring electrode part of the first voltage applying electrode and the second voltage applying electrode. A voltage V (V) is applied between the columnar electrode part of the first voltage applying electrode and the second voltage applying electrode, and an electric current I (A) flowing at this time is measured. Then, the volume resistivity ρv (Ω/cm) of the belt is calculated from the below equation. In the equation, t refers to the thickness of the belt.

$$\rho v=19.6\times(V/I)\times t \quad \text{Equation:}$$

In order to calculate the volume resistivity, a voltage of 500 V is applied for 10 seconds with a circular electrode ("UR probe" of HIRESTA IP manufactured by Mitsubishi Petrochemical Co., Ltd., outer diameter of columnar electrode part: 16 mm, inner diameter of ring electrode part: 30 mm, and outer diameter of ring electrode part: 40 mm) at a temperature of 22° C. and 55% RH, and then the electric current is measured.

The value 19.6 in the above equation is a coefficient of the electrode for conversion into resistivity and determined from $\pi d^2/4t$ in which d (mm) is the outer diameter of the columnar electrode part and t is the thickness (cm) of a sample. The thickness of the belt is measured with an eddy current type film thickness meter (CTR-1500E manufactured by SANKO ELECTRONIC LABORATORY CO., LTD).

The thickness (average thickness) of the intermediate transfer belt is preferably from 0.05 mm to 0.5 mm, more preferably from 0.06 mm to 0.30 mm, and further preferably from 0.06 mm to 0.15 mm.

Second Transfer Unit

The second transfer unit in the image forming apparatus according to the exemplary embodiment will now be described.

The image forming apparatus according to the exemplary embodiment may include a pressure changing unit that can change pressure applied in the second transfer of a toner image to a recording medium.

Specifically, the image forming apparatus may include a pressure changing unit that changes pressure applied in the second transfer by the second transfer unit (e.g., contact pressure between the intermediate transfer body and the second transfer roller) as follows: in the case where a toner image is second transferred to a highly smooth recording medium having a high surface smoothness, pressure is lowered in the region in which the highly smooth recording medium contacts with the intermediate transfer body; in the case where a toner image is second transferred to a less smooth recording medium having a low surface smoothness, pressure is enhanced in the region in which the less smooth recording medium contacts with the intermediate transfer body.

The second transfer unit may include an information acquisition unit that obtains information about the surface smoothness of a recording medium, and the pressure changing unit may adjust pressure applied in the second transfer on the basis of the information from the information acquisition unit.

In image forming apparatuses, a technique that enables high transfer efficiency regardless of the type of a recording medium (such as a recording medium having an uneven surface or a recording medium having a highly smooth surface) has been demanded for the necessity of adaptability to recording media and enhanced image quality. The image forming apparatus that includes the above-mentioned pressure changing unit enables a nip width to be formed in the second transfer part so as to reflect the surface profile of a recording medium, in other words whether the surface of the recording medium has unevenness or not (namely, whether the smoothness is low or high). Hence, even when a recording medium having unevenness (namely, low smoothness) is used, pressure from the intermediate transfer body is sufficiently applied to the inside of the recess of the uneven surface profile, which gives stable transfer performance regardless of the type of a recording medium.

In the image forming apparatus that includes the above-mentioned pressure changing unit, however, using a toner having excessively high or low viscoelasticity at an environmental temperature [normally from room temperature (such as 20° C.) to 60° C.] in the second transfer part causes the occurrence of image defects, such as a white spot or fading, in some cases. In the exemplary embodiment, however, the above-mentioned specific toner is used; in other words, a toner having an appropriate viscoelasticity is used. Hence, even though the image forming apparatus includes the pressure changing unit, the occurrence of a white spot and fading is reduced in formation of an image on a recording medium having an uneven surface.

Pressure Changing Unit

An example of the pressure changing unit will now be described.

Figure 2:
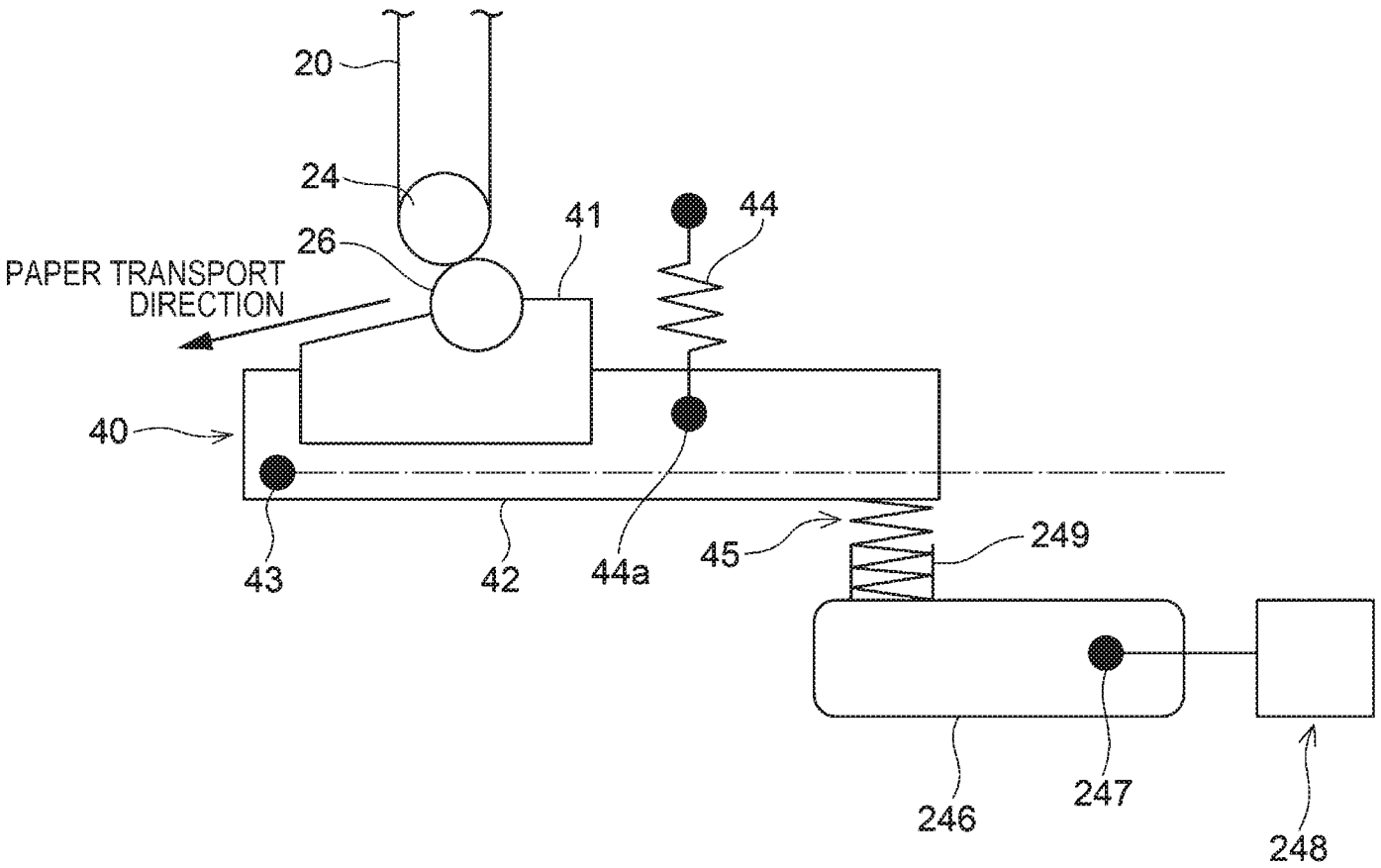
FIG. 2 schematically illustrates the structure of a pressure changing unit of a second transfer unit in a state in which the pressure changing unit applies high pressure to a nip.

FIG. 2 schematically illustrates the structure of a pressure changing device 40 given to the second transfer unit in the image forming apparatus illustrated in FIG. 1.

The pressure changing device 40 applies pressure to the second transfer roller 26 to bring the second transfer roller 26 into contact with part of the intermediate transfer belt 20 that is wound around the support roller 24. The pressure changing device 40 includes a pressure board 42 that holds a second transfer unit 41 that rotatably supports the two ends of the rotational shaft of the second transfer roller 26. The pressure board 42 can turn around a pressure board rotational shaft 43 that is parallel to the rotational shaft of the second transfer roller 26.

The pressure board 42 receives the force of a tension spring 44 and compression spring 45, which are springs as elastic members, on the second transfer roller 26 side relative to the pressure board rotational shaft 43 (on the right side in the drawing), and this structure generates a turning force for the pressure board 42 to turn around the pressure board rotational shaft 43. Owing to this turning force, the second transfer roller 26 contacts the intermediate transfer belt 20 to generate a transfer nip pressure between the second transfer roller 26 and the intermediate transfer belt 20.

The tension spring 44 as a first pressure unit is disposed so as to pull the pressure board 42 from the upside. The compress spring 45 as a second pressure unit is disposed so as to push up the pressure board 42 from the lower side, and the position of the lower end of the compression spring 45 changes in a vertical direction on the basis of the rotational angle of a pressure arm 246. The pressure arm 246 is rotationally driven around a pressure arm rotational shaft 247 by a rotational driving source 248, and the rotational driving source 248 can be controlled by a controller (not illustrated) to change a rotational angular position at which the pressure arm 246 stops.

In the pressure changing device 40, a pair of the tension spring 44 and compression spring 45 that are disposed on one end side in the axial direction of the second transfer roller 26 generate a force, and the force can be used to change applied pressure on this side. The lower end of the compression spring 45 has a pressure stay 249, and the pressure arm 246 pushes up the pressure stay 249 to make the force generated by the compression spring 45 act on the pressure board 42.

Figure 3:
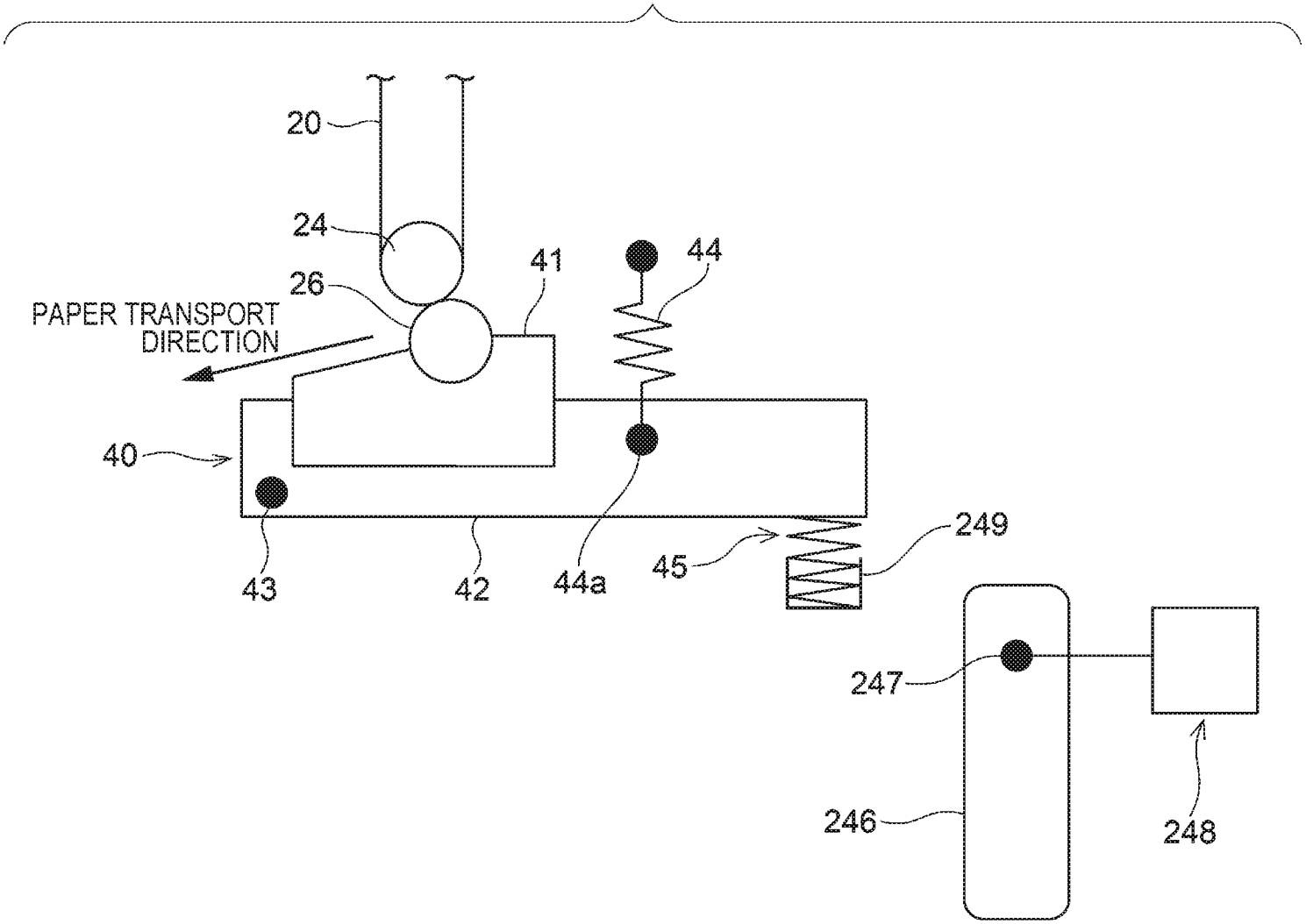
FIG. 3 schematically illustrates the structure of the pressure changing unit of the second transfer unit in a state in which the pressure changing unit applies low pressure to the nip.
Figure 4:
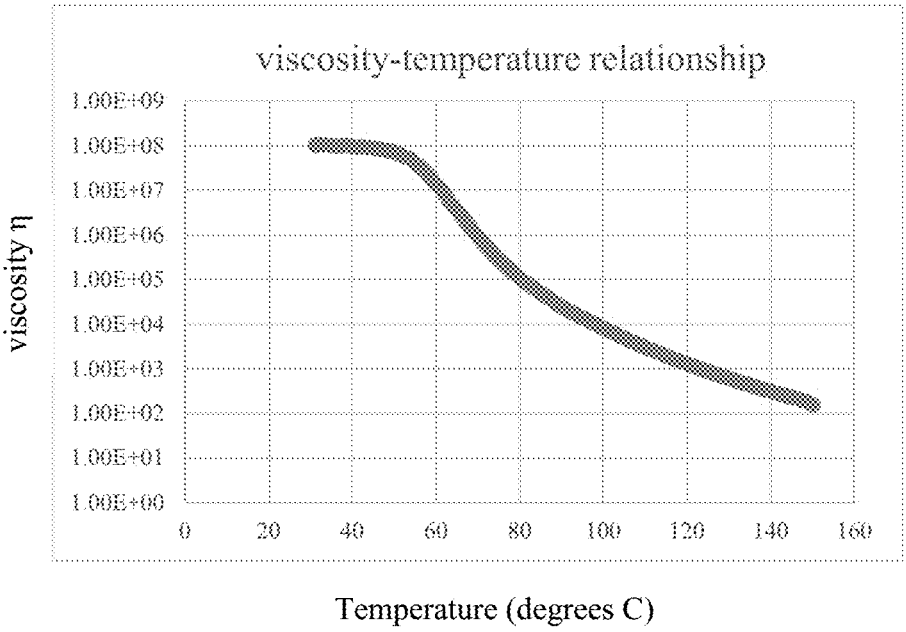
FIG. 4 shows a viscosity-temperature relationship of a non-limiting embodiment.

In the pressure changing device 40, the pressure arm 246 is stopped at a rotational angular position illustrated in FIG. 3 (second rotational angle) to enter a standby position, the pressure arm 246 is therefore separated from the pressure stay 249 attached to the lower end of the compression spring 45, and thus the degree of the compression of the compression spring 45 becomes zero (natural length). In this state, the force of the compression spring 45 does not act on the pressure board 42; hence, the applied pressure on the one end side is only the energizing force of the tension spring 44.

When the pressure arm 246 is stopped at the rotational angular position (first rotational angle) illustrated in FIG. 2 to enter a compression spring pressing state, the pressure arm 246 pushes up the pressure stay 249 attached to the lower end of the compression spring 45. Then, the compression spring 45 is compressed, and the force of the compression spring 45 acts on the pressure board 42. This force of the compression spring 45 enables application of pressure to the pressure board 42. Accordingly, the pressure applied at the one end side of the second transfer roller 26 is the sum of the force of the tension spring 44 and the force of the compression spring 45.

In the case where an image is formed on recording paper P having a highly uneven surface such as embossed paper (namely, less smooth recording medium having a low surface smoothness), two pressure arms 246 of the pressure changing device 40, which are disposed so as to align with each other in the width direction of the second transfer roller 26, are positioned at the first rotational angle as illustrated in FIG. 2. This enables the second transfer roller 26 to contact with the intermediate transfer belt 20 at high applied pressure, and pressure from the intermediate transfer body is sufficiently applied to the inside of the recess of the uneven surface profile of the recording medium, which enables production of stable transfer performance.

In the case where an image is formed on recording paper P having a less uneven surface such as coated paper (namely, highly smooth recording medium having a high surface smoothness), two pressure arms 246 of the pressure changing device 40 are positioned at the second rotational angle as illustrated in FIG. 3. This enables the second transfer roller 26 to contact with the intermediate transfer belt 20 at low applied pressure, which enables production of stable transfer performance.

Information Acquisition Unit

The information acquisition unit will now be described.

A first example of the information acquisition unit is a unit that a user of the image forming apparatus operates to input information about the surface smoothness of a recording medium.

Specifically, in the case where a highly smooth recording medium having a high surface smoothness, such as coated paper, is used as the recording paper P, information of a highly smooth mode is input from an input unit (for example, a button of a highly smooth mode on an operation screen is pressed). In the case where a less smooth recording medium having a low surface smoothness, such as embossed paper, is used as the recording paper P, information of a less smooth mode is input from an input unit (for example, a button of a less smooth mode on an operation screen is pressed).

In particular, the input unit (such as operation screen) serves as the information acquisition unit that can obtain the following information; that is the information at least for deciding whether the recording paper P to which a toner image is to be second transferred is a highly smooth recording medium having a high surface smoothness or a less smooth recording medium having a lower surface smoothness than the highly smooth recording medium.

On the basis of the information obtained from the input unit (such as operation screen), a controller (not illustrated) switches a transfer mode between a highly smooth mode for the second transfer of a toner image to a highly smooth recording medium and a less smooth mode for the second transfer of a toner image to a less smooth recording medium. For instance, when a button of a highly smooth mode on an operation screen is pressed, the transfer mode enters the highly smooth mode. When a button of a less smooth mode on the operation screen is pressed, the transfer mode enters the less smooth mode.

In the case where the information acquisition unit of the first example is used, a highly smooth recording medium having a high surface smoothness and a less smooth recording medium having a low surface smoothness are distinguished from each other, for example, on the basis of the type of the recording paper P.

A second example of the information acquisition unit is a unit having a smoothness detection sensor that detects the surface smoothness of the recording paper P.

The smoothness detection sensor is, for instance, a reflective optical sensor; in the reflective optical sensor, light emitted from a light-emitting device is radiated to the recording paper P in a paper transporting path, and light regularly reflected on the surface of the recording paper P is received by a light-receiving device. The amount of regularly reflected light obtained on the surface of a highly smooth recording medium, such as coated paper, is larger than the amount of regularly reflected light obtained on the surface of a less smooth recording medium such as embossed paper.

The smoothness detection sensor is disposed before the second transfer position in the paper transporting channel. The smoothness detection sensor is electrically connected to a controller (not illustrated), and the controller may perform the correction of the smoothness detection sensor at the activation of the image forming apparatus immediately after the main power thereof is turned on. Specifically, the light-emitting device is activated, the light emitted from the light-emitting device is reflected on the surface of a white guide plate, and the amount of the light emitted from the light-emitting device (supply voltage) is adjusted in this state so that the intended amount of regularly reflected light is obtained. The value of this supply voltage is stored in a memory circuit, and then voltage having the same value as the value of the supply voltage stored in the memory circuit is supplied to the light-emitting device when the smoothness detection sensor detects the amount of light regularly reflected on the surface of the recording paper P.

Once the formation of an image begins, the recording paper P discharged to the paper transporting channel at a predetermined timing faces the smoothness detection sensor. In this state, the controller detects the amount of the light regularly reflected on the surface of the recording medium via the smoothness detection sensor. When the result of the detection exceeds a predetermined threshold value, the recording paper P is determined as a highly smooth recording medium to start the above-mentioned highly smooth mode. When the amount of the regularly reflected light does not exceed a predetermined threshold value, the recording paper P is determined as a less smooth recording medium to start the above-mentioned less smooth mode.

In the case where the image forming apparatus includes the pressure changing device 40 illustrated FIGS. 2 and 3, the beginning of the less smooth mode causes the rotational driving source 248 of the pressure arm 246 to be controlled so that the rotational angular position of the pressure arm 246 of the pressure changing device 40 is at the first rotational angle illustrated in FIG. 2. This enables the second transfer roller 26 to contact with the intermediate transfer belt 20 at a high applied pressure to produce high second transfer nip pressure. Then, the image forming process begins, and pressure from the intermediate transfer body is sufficiently applied to the inside of the recess of the highly uneven surface profile of the recording paper P, such as embossed paper, which enables production of stable transfer performance.

The beginning of the highly smooth mode causes the rotational driving source 248 of the pressure arm 246 to be controlled so that the rotational angular position of the pressure arm 246 of the pressure changing device 40 is at the second rotational angle illustrated in FIG. 3. This enables the second transfer roller 26 to contact the intermediate transfer belt 20 at a low applied pressure to produce low second transfer nip pressure. Then, the image forming process begins, and stable transfer performance is produced on smooth paper having a less uneven surface profile, such as coated paper.

In the case where the information acquisition unit of the second example is used, a highly smooth recording medium having a high surface smoothness and a less smooth recording medium having a low surface smoothness are distinguished from each other, for example, on the basis of whether a result of the detection by the smoothness detection sensor exceeds a predetermined threshold value or not.

The controller (not illustrated) controls the operation of the individual parts of the image forming apparatus according to the exemplary embodiment.

Although not illustrated, a specific example of the controller is a computer; and a central processing unit (CPU), a variety of memories [such as a random access memory (RAM), a read only memory (ROM), and a nonvolatile memory], and input and output (I/O) interface are connected to each other via a bus.

The CPU, for example, executes program stored in a variety of memories and controls the operation of the individual parts of the image forming apparatus. A memory medium that stores the program to be executed by the CPU is not limited to a variety of memories. The recording medium, for instance, may be a flexible disk, a digital video disk (DVD), a magneto-optical disk, or a universal serial bus (USB) memory (not illustrated); alternatively, it may be a memory of another device connected to a communication unit (not illustrated).

Examples of the recording paper P to which the toner image is transferred include plain paper used in electrophotographic duplicator machines, printers, and other apparatuses. Besides the recording paper P, the recording medium may be, for instance, an overhead projector (OHP) sheet.

The surface of the recording paper P is suitably smooth in order to enhance the smoothness of the surface of the image after the fixing process; for example, coated paper in which the surface of plain paper has been coated with resin or another material and printing art paper are suitably used.

The recording paper P is transported to a discharge part after the fixing of a color image is finished, and the process for forming a color image is completed.

The image forming apparatus illustrated in FIG. 1 has a structure in which the toner cartridges 8Y, 8M, 8C, and 8K are detachable; and the developing devices 4Y, 4M, 4C, and 4K are connected to the toner cartridges of the corresponding colors via toner supplying tubes (not illustrated). When the toners accommodated in the toner cartridges run short, the toner cartridges are replaced.

EXAMPLES

Examples of the present disclosure will now be described, but the present disclosure is not limited to Examples described below. In the following description, the terms "part" and "%" are on a mass basis unless otherwise specified.

The viscosity and maximum endothermic peak temperature of toner and absorbance at individual wavenumbers are measured in the manner described above.

Developers A1 to A13 and B1 to B3

Preparation of Dispersion Liquid of Styrene Acrylic Resin Particle

Production of Dispersion Liquid (1) of Resin Particles

Styrene: 200 parts
n-butylacrylate: 50 parts
Acrylic acid: 1 part
β-carboxyethyl acrylate: 3 parts
Propanediol diacrylate: 1 part
2-hydroxyethyl acrylate: 0.5 parts
Dodecanthiol: 1 part A solution of 4 parts of an anionic surfactant (DOWFAX manufactured by The Dow Chemical Company) in 550 parts of ion exchanged water is put into a flask, a liquid mixture of the above-mentioned materials is put thereinto to emulsify the content in the flask. Then, a solution of 6 parts of ammonium sulfate in 50 parts of ion exchanged water is put into the flask while the emulsified liquid is slowly stirred for 10 minutes. Nitrogen inside the system is well purged, the flask is heated in an oil bath until the temperature inside the system reaches 75° C., and polymerization is carried out for 30 minutes.

Styrene: 110 parts
n-butylacrylate: 50 parts
β-carboxyethyl acrylate: 5 parts
1,10-decanediol diacrylate: 2.5 parts
Dodecanthiol: 2 parts These materials are mixed with each other to prepare an emulsified liquid. The emulsified liquid is put into the above-mentioned flask over 120 minutes, and emulsion polymerization is continued for 4 hours in this state. Thorough this process, a dispersion liquid of resin particles in which resin particles having a weight average molecular weight of 32,000, a glass transition temperature of 53° C., and a volume average particle size of 240 nm have been dispersed is produced. Ion exchanged water is added to the dispersion liquid of resin particles to adjust the solid content to 20 mass %, thereby yielding a dispersion liquid (1) of resin particles.

Production of Dispersion Liquid (2) of Resin Particles

Styrene: 200 parts
n-butylacrylate: 50 parts
Acrylic acid: 1 part
β-carboxyethyl acrylate: 3 parts
Propanediol diacrylate: 1 part
2-hydroxyethyl acrylate: 0.5 parts
Dodecanthiol: 1.5 parts A solution of 4 parts of an anionic surfactant (DOWFAX manufactured by The Dow Chemical Company) in 550 parts of ion exchanged water is put into a flask, a liquid mixture of the above-mentioned materials is put thereinto to emulsify the content in the flask. Then, a solution of 6 parts of ammonium sulfate in 50 parts of ion exchanged water is put into the flask while the emulsified liquid is slowly stirred for 10 minutes. Nitrogen inside the system is well purged, the flask is heated in an oil bath until the temperature inside the system reaches 75° C., and polymerization is carried out for 30 minutes.

Styrene: 110 parts
n-butylacrylate: 50 parts
β-carboxyethyl acrylate: 5 parts
1,10-decanediol diacrylate: 2.5 parts
Dodecanthiol: 2.5 parts These materials are mixed with each other to prepare an emulsified liquid. The emulsified liquid is put into the above-mentioned flask over 120 minutes, and emulsion polymerization is continued for 4 hours in this state. Thorough this process, a dispersion liquid of resin particles in which resin particles having a weight average molecular weight of 30,000, a glass transition temperature of 53° C., and a volume average particle size of 220 nm have been dispersed is produced. Ion exchanged water is added to the dispersion liquid of resin particles to adjust the solid content to 20 mass %, thereby yielding a dispersion liquid (2) of resin particles.

Production of Dispersion Liquid (3) of Resin Particles

Styrene: 200 parts
n-butylacrylate: 50 parts
Acrylic acid: 1 part
β-carboxyethyl acrylate: 3 parts
Propanediol diacrylate: 1 part
2-hydroxyethyl acrylate: 0.5 parts
Dodecanthiol: 1.5 parts A solution of 4 parts of an anionic surfactant (DOWFAX manufactured by The Dow Chemical Company) in 550 parts of ion exchanged water is put into a flask, a liquid mixture of the above-mentioned materials is put thereinto to emulsify the content in the flask. Then, a solution of 7 parts of ammonium sulfate in 50 parts of ion exchanged water is put into the flask while the emulsified liquid is slowly stirred for 10 minutes. Nitrogen inside the system is well purged, the flask is heated in an oil bath until the temperature inside the system reaches 80° C., and polymerization is carried out for 30 minutes.

Styrene: 110 parts
n-butylacrylate: 50 parts
β-carboxyethyl acrylate: 5 parts
1,10-decanediol diacrylate: 2.5 parts
Dodecanthiol: 3.0 parts These materials are mixed with each other to prepare an emulsified liquid. The emulsified liquid is put into the above-mentioned flask over 120 minutes, and emulsion polymerization is continued for 4 hours in this state.

Thorough this process, a dispersion liquid of resin particles in which resin particles having a weight average molecular weight of 28,000, a glass transition temperature of 53° C., and a volume average particle size of 230 nm have been dispersed is produced. Ion exchanged water is added to the dispersion liquid of resin particles to adjust the solid content to 20 mass %, thereby yielding a dispersion liquid (3) of resin particles.

Production of Dispersion Liquid (4) of Resin Particles

Styrene: 200 parts
n-butylacrylate: 50 parts
Acrylic acid: 1 part
β-carboxyethyl acrylate: 3 parts
Propanediol diacrylate: 1 part
2-hydroxyethyl acrylate: 0.5 parts
Dodecanthiol: 2.0 parts A solution of 4 parts of an anionic surfactant (DOWFAX manufactured by The Dow Chemical Company) in 550 parts of ion exchanged water is put into a flask, a liquid mixture of the above-mentioned materials is put thereinto to emulsify the content in the flask. Then, a solution of 7.5 parts of ammonium sulfate in 50 parts of ion exchanged water is put into the flask while the emulsified liquid is slowly stirred for 10 minutes. Nitrogen inside the system is well purged, the flask is heated in an oil bath until the temperature inside the system reaches 85° C., and polymerization is carried out for 30 minutes.

Styrene: 110 parts
n-butylacrylate: 50 parts
β-carboxyethyl acrylate: 5 parts
1,10-decanediol diacrylate: 2.5 parts
Dodecanthiol: 3.5 parts These materials are mixed with each other to prepare an emulsified liquid. The emulsified liquid is put into the above-mentioned flask over 120 minutes, and emulsion polymerization is continued for 4 hours in this state. Thorough this process, a dispersion liquid of resin particles in which resin particles having a weight average molecular weight of 26,500, a glass transition temperature of 53° C., and a volume average particle size of 210 nm have been dispersed is produced. Ion exchanged water is added to the dispersion liquid of resin particles to adjust the solid content to 20 mass %, thereby yielding a dispersion liquid (4) of resin particles.

Production of Dispersion Liquid (5) of Resin Particles

Styrene: 200 parts
n-butylacrylate: 50 parts
Acrylic acid: 1 part
β-carboxyethyl acrylate: 3 parts
Propanediol diacrylate: 1 part
2-hydroxyethyl acrylate: 0.5 parts
Dodecanthiol: 0.8 parts A solution of 4 parts of an anionic surfactant (DOWFAX manufactured by The Dow Chemical Company) in 550 parts of ion exchanged water is put into a flask, a liquid mixture of the above-mentioned materials is put thereinto to emulsify the content in the flask. Then, a solution of 5.5 parts of ammonium sulfate in 50 parts of ion exchanged water is put into the flask while the emulsified liquid is slowly stirred for 10 minutes. Nitrogen inside the system is well purged, the flask is heated in an oil bath until the temperature inside the system reaches 85° C., and polymerization is carried out for 30 minutes.

Styrene: 110 parts
n-butylacrylate: 50 parts
β-carboxyethyl acrylate: 5 parts
1,10-decanediol diacrylate: 2.5 parts
Dodecanthiol: 1.7 parts These materials are mixed with each other to prepare an emulsified liquid. The emulsified liquid is put into the above-mentioned flask over 120 minutes, and emulsion polymerization is continued for 4 hours in this state.

Thorough this process, a dispersion liquid of resin particles in which resin particles having a weight average molecular weight of 36,000, a glass transition temperature of 53° C., and a volume average particle size of 260 nm have been dispersed is produced. Ion exchanged water is added to the dispersion liquid of resin particles to adjust the solid content to 20 mass %, thereby yielding a dispersion liquid (5) of resin particles.

Preparation of Dispersion Liquid of Magenta Colored Particles

C.I. Pigment Red 122: 50 parts
Ionic surfactant NEOGEN RK (manufactured by DKS Co. Ltd.): 5 parts
Ion exchanged water: 220 parts These materials are mixed with each other and processed with ULTIMIZER (manufactured by Sugino Machine Limited) at 240 MPa for 10 minutes to prepare a dispersion liquid of magenta colored particles (solid content concentration: 20%).

Preparation of Dispersion Liquid (1) of Release Agent Particles

Ester wax (WEP-2 manufactured by NOF CORPORATION): 100 parts
Anionic surfactant (NEOGEN RK manufactured by DKS Co. Ltd.): 2.5 parts
Ion exchanged water: 250 parts These materials are mixed with each other, heated to 120° C., and then dispersed with a homogenizer (ULTRA-TURRAX T50 manufactured by IKA Works, Inc.). The resulting product is further dispersed with a Manton-Gaulin high-pressure homogenizer (manufactured by Gaulin Corporation), thereby producing a dispersion liquid (1) of release agent particles in which release agent particles having a volume average particle size of 330 nm have been dispersed (solid content: 29.1%).

Preparation of Dispersion Liquid (2) of Release Agent Particles

Fischer-Tropsch wax (HNP-9 manufactured by NIPPON SEIRO CO., LTD.): 100 parts
Anionic surfactant (NEOGEN RK manufactured by DKS Co. Ltd.): 2.5 parts
Ion exchanged water: 250 parts These materials are mixed with each other, heated to 120° C., and then dispersed with a homogenizer (ULTRA-TURRAX T50 manufactured by IKA Works, Inc.). The resulting product is further dispersed with a Manton-Gaulin high-pressure homogenizer (manufactured by Gaulin Corporation), thereby producing a dispersion liquid (2) of release agent particles in which release agent particles having a volume average particle size of 340 nm have been dispersed (solid content: 29.2%).

Preparation of Dispersion Liquid (3) of Release Agent Particles

Paraffin wax (FNP0090 manufactured by NIPPON SEIRO CO., LTD.): 100 parts

Anionic surfactant (NEOGEN RK manufactured by DKS Co. Ltd.): 2.5 parts

Ion exchanged water: 250 parts

These materials are mixed with each other, heated to 120° C., and then dispersed with a homogenizer (ULTRA-TURRAX T50 manufactured by IKA Works, Inc.). The resulting product is further dispersed with a Manton-Gaulin high-pressure homogenizer (manufactured by Gaulin Corporation), thereby producing a dispersion liquid (3) of release agent particles in which release agent particles having a volume average particle size of 360 nm have been dispersed (solid content: 29.0%).

Preparation of Dispersion Liquid (4) of Release Agent Particles

Polyethylene wax (POLYWAX 725 manufactured by TOYO ADL CORPORATION): 100 parts

Anionic surfactant (NEOGEN RK manufactured by DKS Co. Ltd.): 2.5 parts

Ion exchanged water: 250 parts

These materials are mixed with each other, heated to 100° C., and then dispersed with a homogenizer (ULTRA-TURRAX T50 manufactured by IKA Works, Inc.). The resulting product is further dispersed with a Manton-Gaulin high-pressure homogenizer (manufactured by Gaulin Corporation), thereby producing a dispersion liquid (4) of release agent particles in which release agent particles having a volume average particle size of 370 nm have been dispersed (solid content: 29.3%).

Production of Toner A1

Ion exchanged water: 400 parts

Dispersion Liquid (3) of Resin Particles: 200 parts

Dispersion Liquid of Magenta Colored Particles: 40 parts

Dispersion Liquid (2) of Release Agent Particles: 12 parts

Dispersion Liquid (3) of Release Agent Particles: 24 parts

These materials are put into a reaction vessel equipped with a thermometer, a pH meter, and a stirrer and retained for 30 minutes at 30° C. and a stirring rotation rate of 150 rpm while the temperature is externally controlled with a mantle heater.

An aqueous solution of 2.1 parts of polyaluminum chloride (PAC, manufactured by Oji Paper Co., Ltd., 30% powder) in 100 parts of ion exchanged water is added thereto while being dispersed with a homogenizer (ULTRA-TURRAX T50 manufactured by IKA Works, Inc.). The temperature is subsequently increased to 50° C., the particle size is measured with COULTER MULTISIZER II (aperture diameter of 50 μm, manufactured by Beckman Coulter, Inc.), and the volume average particle size is determined as 5.0 μm. Then, 115 parts of the dispersion liquid (1) of resin particles is added thereto to make the resin particles adhere to the surfaces of aggregated particles (shell structure).

Then, 20 parts of a 10-mass % aqueous solution of a nitrilotriacetic acid (NTA) metal salt (CHELEST 70 manufactured by CHELEST CORPORATION) is added thereto, and its pH is adjusted to 9.0 with a 1-N aqueous solution of sodium hydroxide. The temperature is subsequently increased to 91° C. at a temperature increase rate of 0.05° C./min and maintained at 91° C. for 3 hours, and then the resulting toner slurry is cooled to 85° C. and retained for an hour. Then, the temperature is decreased to 25° C. to produce a magenta toner. The magenta toner is dispersed in ion exchanged water and filtrated. This procedure is repeated to wash the magenta toner until the electric conductivity of the filtrate becomes 20 μS/cm or less. The resulting magenta toner is dried in an oven at 40° C. for 5 hours under vacuum to yield toner particles.

Then, 1.5 parts of hydrophobic silica (RY50, manufactured by NIPPON AEROSIL CO., LTD.) and 1.0 part of hydrophobic titanium oxide (T805, manufactured by NIPPON AEROSIL CO., LTD.) are added to 100 parts of the toner particles, and the resulting product is mixed using a sample mill at 10,000 rpm for 30 seconds. The mixture is screened with a vibrating sieve having an aperture size of 45 μm to yield a toner A1 (electrostatic charge image developing toner A1). The toner A1 has a volume average particle size of 5.7 μm.

Production of Developer A1

In a V blender, 8 parts of the toner A1 is mixed with 92 parts of a carrier to produce a developer A1 (electrostatic charge image developer A1).

Production of Developers A2 to A13 and Developers B1 and B2

The dispersion liquid of resin particles, the dispersion liquid of release agent particles, the amount of a coagulant, a coalescence temperature, a retention temperature, and a retention time are changed as shown in Table 1. Except for these changes, magenta toners of toners A2 to A13 and toners B1 and B2 are produced as in the production of the toner A1.

Except that these toners are used, electrostatic charge image developers of developers A2 to A13 and developers B1 and B2 are produced as in the production of the developer A1.

Production of Developer B3

The dispersion liquid of resin particles, the dispersion liquid of release agent particles, the amount of a coagulant, a coalescence temperature, a retention temperature, and a retention time are changed as shown in Table 1. Except for these changes, a magenta toner of toner B3 is produced as in the production of the toner A1.

Except that this toner is used, an electrostatic charge image developer of a developer B3 is produced as in the production of the developer A1.

TABLE 1

| Toner | (Inη (T1) − Inη (T2))/(T1 − T2) | (Inη (T2) − Inη (T3))/(T2 − T3) | (Inη (T0) − Inη (T1))/(T0 − T1) | (Inη (T2) − Inη (T3))/(T2 − T3) − (Inη (T1) − Inη (T2))/(T1 − T2) | (Inη (T0) − Inη (T1))/(T0 − T1) − (Inη (T1) − Inη (T2))/(T1 − T2) | Maximum endothermic peak temperature of toner (° C.) | a/b | c/d | Dispersion liquid of resin particles |
|---|---|---|---|---|---|---|---|---|---|
| A1 | −0.215 | −0.090 | −0.110 | 0.125 | 0.105 | 85 | 5.0 | 2.9 | (3) |
| A2 | −0.168 | −0.080 | −0.085 | 0.088 | 0.083 | 85 | 5.1 | 2.5 | (2) |
| A3 | −0.143 | −0.100 | −0.078 | 0.043 | 0.065 | 85 | 4.9 | 2.6 | (1) |
| A4 | −0.213 | −0.090 | −0.106 | 0.123 | 0.107 | 85 | 5.0 | 2.8 | (3) |
| A5 | −0.214 | −0.100 | −0.110 | 0.114 | 0.104 | 85 | 5.1 | 2.4 | (3) |
| A6 | −0.154 | −0.135 | −0.077 | 0.019 | 0.077 | 70 | 5.1 | 2.6 | (1) |
| A7 | −0.153 | −0.133 | −0.080 | 0.020 | 0.073 | 100 | 4.9 | 2.8 | (1) |

TABLE 1-continued

| | | | | | | | | | |
|---|---|---|---|---|---|---|---|---|---|
| A8 | −0.155 | −0.141 | −0.083 | 0.014 | 0.072 | 63 | 5.0 | 2.5 | (1) |
| A9 | −0.156 | −0.136 | −0.079 | 0.020 | 0.077 | 102 | 5.1 | 2.9 | (1) |
| A10 | −0.152 | −0.141 | −0.073 | 0.011 | 0.079 | 85 | 1.5 | 1.3 | (1) |
| A11 | −0.153 | −0.142 | −0.071 | 0.011 | 0.082 | 85 | 7.2 | 3.5 | (1) |
| A12 | −0.155 | −0.135 | −0.075 | 0.020 | 0.080 | 85 | 8.5 | 4.5 | (1) |
| A13 | −0.154 | −0.134 | −0.078 | 0.020 | 0.076 | 85 | 0.7 | 0.6 | (1) |
| B1 | −0.129 | −0.090 | −0.068 | 0.039 | 0.061 | 85 | 5.3 | 2.9 | (5) |
| B2 | −0.215 | −0.155 | −0.113 | 0.060 | 0.102 | 85 | 5.3 | 2.9 | (3) |
| B3 | −0.180 | −0.186 | −0.109 | −0.006 | 0.071 | 85 | 5.3 | 2.9 | (4) |

| | First dispersion liquid of release agent particles | | Second dispersion liquid of release agent particles | | Conditions in production of toner | | | |
|---|---|---|---|---|---|---|---|---|
| Toner | Type | Part | Type | Part | Amount of coagulant (part) | Coalescence temperature (° C.) | Retention temperature (° C.) | Retention time (hour) |
| A1 | (2) | 12 | (3) | 24 | 2.1 | 91 | 85 | 1 |
| A2 | (2) | 12 | (3) | 24 | 2.1 | 92 | 85 | 1 |
| A3 | (2) | 12 | (3) | 24 | 2.1 | 93 | 85 | 1 |
| A4 | (2) | 12 | (3) | 24 | 1.9 | 92 | 85 | 1 |
| A5 | (2) | 12 | (3) | 24 | 1.7 | 91 | 85 | 1 |
| A6 | (1) | 12 | (2) | 24 | 1.7 | 77 | 70 | 1 |
| A7 | (3) | 12 | (4) | 24 | 1.7 | 108 | 95 | 1 |
| A8 | (1) | 28.8 | (2) | 7.2 | 1.7 | 70 | 65 | 1 |
| A9 | (3) | 7.2 | (4) | 28.8 | 1.7 | 108 | 95 | 1 |
| A10 | (2) | 12 | (3) | 24 | 1.7 | 91 | 85 | 0.5 |
| A11 | (2) | 12 | (3) | 24 | 1.7 | 92 | 85 | 2 |
| A12 | (2) | 12 | (3) | 24 | 1.7 | 93 | 85 | 3 |
| A13 | (2) | 12 | (3) | 24 | 1.7 | 92 | 85 | 0.25 |
| B1 | (2) | 12 | (3) | 24 | 2.1 | 91 | 85 | 1 |
| B2 | (2) | 12 | (3) | 24 | 1.5 | 93 | 85 | 1 |
| B3 | (2) | 12 | (3) | 24 | 2.1 | 93 | 85 | 1 |

Production of Intermediate Transfer Belts A1 to A4

Four belts A1 to A4 having a difference in micro rubber hardness are prepared as an intermediate transfer belt. In each of the belts, a polyimide resin layer which serves as a base layer having a thickness of 60 μm is coated with an acrylic rubber layer which serves as an elastic layer having a thickness of 390 μm and in which melamine particles having an average particle size of 1.5 μm have been dispersed.

The amount of the melamine particles contained in the elastic layer is changed to produce the four belts A1 to A4 of which the circumferential surfaces have a different micro rubber hardness.

The micro rubber hardness of the circumferential surfaces of the intermediate transfer belts A1 to A4 is measured in the manner described above, and Tables 2 and 3 show the measured micro rubber hardness.

Examples 1 to 52 and Comparative Examples 1 to 12

The developers shown in Tables 2 and 3 are individually put into the developing unit of a commercially available electrophotographic duplicator machine (DOCUCENTRE COLOR 450 manufactured by Fuji Xerox Co., Ltd.), and the intermediate transfer belts shown in Tables 2 and 3 are individually attached to this duplicator machines.

Evaluation

High-temperature and High-humidity Environment

Each of the electrophotographic duplicator machines of Examples and Comparative Examples is used to form a low-density image (average image density: 0.5%) on 1000 sheets of embossed paper [recording medium having an uneven surface profile, manufactured by Tokushu Tokai Paper Co., Ltd., trade name: LEATHAC (registered trademark) 66] in a high-temperature and high-humidity environment (28° C. and 85% RH) A transfer mode for a less smooth recording medium having a low surface smoothness is assumed, and the nip pressure applied between the embossed paper and the intermediate transfer belt at the second transfer position is adjusted to be 1.2 times as large as normal nip pressure.

Low-temperature and Low-humidity Environment

Each of the electrophotographic duplicator machines of Examples and Comparative Examples is used to form a high-density image (average image density: 50%) on 1000 sheets of embossed paper [recording medium having an uneven surface profile, manufactured by Tokushu Tokai Paper Co., Ltd., trade name: LEATHAC (registered trademark) 66] in a low-temperature and low-humidity environment (10° C. and 15% RH) A transfer mode for a less smooth recording medium having a low surface smoothness is assumed, and the nip pressure applied between the embossed paper and the intermediate transfer belt at the second transfer position is adjusted to be 1.2 times as large as normal nip pressure.

Evaluation of White Spot (Image Defect)

The images output at last in both the high-temperature and high-humidity environment and the low-temperature and low-humidity environment are observed to evaluate the occurrence of a white spot on the basis of the following criteria.

A: White spot is not found through visual observation and observation with a loupe B: White spot is not found through visual observation, but less than 10 slight white spots are found in a field of view (1000 μm×1000 μm) through observation with a loupe (magnification: 200 times)

C: White spot is not found through visual observation, but 10 or more slight white spots are found in a field of view through observation with a loupe D: White spot is visually observed

TABLE 2

| | | Developer | Intermediate transfer belt Type | Intermediate transfer belt Hardness | 28° C. 85% RH White spot | 10° C. 15% RH White spot |
|---|---|---|---|---|---|---|
| Example | 1 | A1 | A1 | 45 | A | A |
| | 2 | A2 | | | A | A |
| | 3 | A3 | | | A | B |
| | 4 | A4 | | | A | A |
| | 5 | A5 | | | B | A |
| | 6 | A6 | | | B | A |
| | 7 | A7 | | | A | A |
| | 8 | A8 | | | A | A |
| | 9 | A9 | | | A | A |
| | 10 | A10 | | | A | C |
| | 11 | A11 | | | B | C |
| | 12 | A12 | | | B | B |
| | 13 | A13 | | | B | A |
| Comparative Example | 1 | B1 | | | A | D |
| | 2 | B2 | | | D | B |
| | 3 | B3 | | | D | C |
| Example | 14 | A1 | A2 | 50 | A | A |
| | 15 | A2 | | | A | A |
| | 16 | A3 | | | A | A |
| | 17 | A4 | | | A | A |
| | 18 | A5 | | | A | A |
| | 19 | A6 | | | A | A |
| | 20 | A7 | | | A | A |
| | 21 | A8 | | | A | A |
| | 22 | A9 | | | A | A |
| | 23 | A10 | | | A | C |
| | 24 | A11 | | | B | C |
| | 25 | A12 | | | B | B |
| | 26 | A13 | | | B | A |
| Comparative Example | 4 | B1 | | | A | D |
| | 5 | B2 | | | D | B |
| | 6 | B3 | | | D | C |

TABLE 3

| | | Developer | Intermediate transfer belt Type | Intermediate transfer belt Hardness | 28° C. 85% RH White spot | 10° C. 15% RH White spot |
|---|---|---|---|---|---|---|
| Example | 27 | A1 | A3 | 60 | A | A |
| | 28 | A2 | | | A | A |
| | 29 | A3 | | | A | A |
| | 30 | A4 | | | A | A |
| | 31 | A5 | | | A | A |
| | 32 | A6 | | | A | A |
| | 33 | A7 | | | A | A |
| | 34 | A8 | | | A | A |
| | 35 | A9 | | | A | A |
| | 36 | A10 | | | A | C |
| | 37 | A11 | | | B | C |
| | 38 | A12 | | | B | B |
| | 39 | A13 | | | B | A |
| Comparative Example | 7 | B1 | | | A | D |
| | 8 | B2 | | | D | B |
| | 9 | B3 | | | D | C |
| Example | 40 | A1 | A4 | 65 | A | A |
| | 41 | A2 | | | A | A |
| | 42 | A3 | | | A | B |
| | 43 | A4 | | | A | A |
| | 44 | A5 | | | B | A |
| | 45 | A6 | | | B | A |
| | 46 | A7 | | | A | A |
| | 47 | A8 | | | A | A |
| | 48 | A9 | | | A | A |
| | 49 | A10 | | | A | C |

TABLE 3-continued

| | | Developer | Intermediate transfer belt Type | Intermediate transfer belt Hardness | 28° C. 85% RH White spot | 10° C. 15% RH White spot |
|---|---|---|---|---|---|---|
| | 50 | A11 | | | B | C |
| | 51 | A12 | | | B | B |
| | 52 | A13 | | | B | A |
| Comparative Example | 10 | B1 | | | A | D |
| | 11 | B2 | | | D | B |
| | 12 | B3 | | | D | C |

From Tables 2 and 3, the image defect of the occurrence of a white spot is reduced more in the image forming apparatuses of Examples using the toners that satisfy the requirements of $(\ln \eta(T1)-\ln \eta(T2))/(T1-T2)$ of −0.14 or less, $(\ln \eta(T2)-\ln \eta(T3))/(T2-T3)$ of −0.15 or more, and $(\ln \eta(T2)-\ln \eta(T3))/(T2-T3)$ being greater than $(\ln \eta(T1)-\ln \eta(T2))/(T1-T2)$ than in the image forming apparatuses of Comparative Examples using the toners that do not satisfy at least one of these requirements.

Developers A101 to A113 and Developers B101 to B103

Preparations of Dispersion Liquid of Amorphous Polyester Resin Particles

Production of Dispersion Liquid (101) of Resin Particles

Into a three-neck flask of which the inside has been dried, 60 parts of dimethyl terephthalate, 74 parts of dimethyl fumarate, 30 parts of dodecenylsuccinic anhydride, 22 parts of trimellitic acid, 138 parts of propylene glycol, and 0.3 parts of dibutyltin oxide are put. The mixture is reacted at 185° C. for 3 hours under nitrogen atmosphere while water generated during the reaction is removed to the outside. Then, the temperature is increased up to 240° C. while the pressure is gradually reduced, and the resulting product is further reacted for 4 hours and then cooled. Through this process, an amorphous polyester resin (101) having a weight average molecular weight of 39,000 is produced.

Then, 200 parts of the amorphous polyester resin (101) of which the insoluble content has been removed, 100 parts of methyl ethyl ketone, 35 parts of isopropyl alcohol, and 7.0 parts of a 10-mass % aqueous solution of ammonium are put into a separable flask. The content of the separable flask is sufficiently mixed and dissolved, and then ion exchanged water is dropped thereto with a liquid delivery pump at a liquid delivery rate of 8 g/min under stirring at 40° C. After the solution becomes evenly clouded, the liquid delivery rate is changed to 15 g/min to change the phase, and the dropping is stopped once the amount of the delivered liquid reaches 580 parts. The solvent is subsequently removed under vacuum to yield a dispersion liquid (101) of amorphous polyester resin particles [dispersion liquid (101) of resin particles]. The polyester resin particles have a volume average particle size of 170 nm and a solid content concentration of 35%.

Production of Dispersion Liquids (102) to (105) of Resin Particles

Dispersion liquids (102) to (105) of resin particles are produced as in the production of the dispersion liquid (101) of resin particles except that the conditions are changed as shown in Table 4.

TABLE 4

| | Polymerization time of resin | Weight average molecular weight of polyester resin |
|---|---|---|
| Dispersion liquid of amorphous polyester resin particles (101) | 3 hours at 185° C., 4 hours at 240° C. | 39,000 |
| Dispersion liquid of amorphous polyester resin particles (102) | 2.5 hours at 185° C., 3.5 hours at 240° C. | 37,000 |
| Dispersion liquid of amorphous polyester resin particles (103) | 2 hours at 185° C., 3 hours at 240° C. | 35,000 |
| Dispersion liquid of amorphous polyester resin particles (104) | 1.5 hours at 185° C., 2.5 hours at 240° C. | 33,000 |
| Dispersion liquid of amorphous polyester resin particles (105) | 4 hours at 185° C., 5 hours at 240° C. | 43,000 |

Production of Toner A101

Ion exchanged water: 400 parts

Dispersion Liquid (103) of Amorphous Polyester Resin Particles: 200 parts

Dispersion Liquid of Magenta Colored Particles: 40 parts

Dispersion Liquid (2) of Release Agent Particles: 12 parts

Dispersion Liquid (3) of Release Agent Particles: 24 parts

These materials are put into a reaction vessel equipped with a thermometer, a pH meter, and a stirrer and retained for 30 minutes at 30° C. and a stirring rotation rate of 150 rpm while the temperature is externally controlled with a mantle heater.

An aqueous solution of 2.1 parts of polyaluminum chloride (PAC, manufactured by Oji Paper Co., Ltd., 30% powder) in 100 parts of ion exchanged water is added thereto while being dispersed with a homogenizer (ULTRA-TURRAX T50 manufactured by IKA Works, Inc.). The temperature is subsequently increased to 50° C., the particle size is measured with COULTER MULTISIZER II (aperture diameter of 50 μm, manufactured by Beckman Coulter, Inc.), and the volume average particle size is determined as 4.9 μm. Then, 115 parts of the dispersion liquid (101) of amorphous polyester resin particles is added thereto to make the resin particles adhere to the surfaces of aggregated particles (shell structure).

Then, 20 parts of a 10-mass % aqueous solution of a nitrilotriacetic acid (NTA) metal salt (CHELEST 70 manufactured by CHELEST CORPORATION) is added thereto, and its pH is adjusted to 9.0 with a 1-N aqueous solution of sodium hydroxide. The temperature is subsequently increased to 91° C. at a temperature increase rate of 0.05° C./min and maintained at 91° C. for 3 hours, and then the resulting toner slurry is cooled to 85° C. and retained for an hour. Then, the temperature is decreased to 25° C. to produce a magenta toner. The magenta toner is dispersed in ion exchanged water and filtrated. This procedure is repeated to wash the magenta toner until the electric conductivity of the filtrate becomes 20 μS/cm or less. The resulting product is dried in an oven at 40° C. for 5 hours under vacuum to yield toner particles.

Then, 1.5 parts of hydrophobic silica (RY50, manufactured by NIPPON AEROSIL CO., LTD.) and 1.0 part of hydrophobic titanium oxide (T805, manufactured by NIPPON AEROSIL CO., LTD.) are added to 100 parts of the toner particles, and the resulting product is mixed and blended using a sample mill at 10,000 rpm for 30 seconds. The mixture is screened with a vibrating sieve having an aperture size of 45 μm to yield a toner A101 (electrostatic charge image developing toner A101). The toner A101 has a volume average particle size of 5.8 μm.

Production of Developer A101

In a V blender, 8 parts of the toner A101 is mixed with 92 parts of a carrier to produce a developer A101 (electrostatic charge image developer A101).

Production of Developers A102 to A113 and Developers B101 and B102

The dispersion liquid of resin particles, the dispersion liquid of release agent particles, the amount of a coagulant, a coalescence temperature, a retention temperature, and a retention time are changed as shown in Table 5. Except for these changes, magenta toners of toners A102 to A113 and toners B101 and B102 are produced as in the production of the toner A101.

Except that these toners are used, electrostatic charge image developers of developers A102 to A113 and developers B101 and B102 are produced as in the production of the developer A101.

Production of Developer B103

The dispersion liquid of resin particles, the dispersion liquid of release agent particles, the amount of a coagulant, a coalescence temperature, a retention temperature, and a retention time are changed as shown in Table 5. Except for these changes, a magenta toner of toner B103 is produced as in the production of the toner A101.

Except that this toner is used, an electrostatic charge image developer of a developer B103 is produced as in the production of the developer A101.

TABLE 5

| Toner | (Inη (T1) − Inη (T2))/(T1 − T2) | (Inη (T2) − Inη (T3))/(T2 − T3) | (Inη (T0) − Inη (T1))/(T0 − T1) | (Inη (T2) − Inη (T3))/(T2 − T3) − (Inη (T1) − Inη (T2))/(T1 − T2) | (Inη (T0) − Inη (T1))/(T0 − T1) − (Inη (T1) − Inη (T2))/(T1 − T2) | Maximum endothermic peak temperature of toner (° C.) | a/b | c/d | 1,500 $cm^{-1}$/720 $cm^{-1}$ | 820 $cm^{-1}$/720 $cm^{-1}$ |
|---|---|---|---|---|---|---|---|---|---|---|
| A101 | −0.220 | −0.110 | −0.100 | 0.110 | 0.120 | 85 | 5.2 | 2.7 | 0.30 | 0.16 |
| A102 | −0.163 | −0.070 | −0.080 | 0.093 | 0.083 | 85 | 4.9 | 2.3 | 0.31 | 0.15 |
| A103 | −0.141 | −0.100 | −0.065 | 0.041 | 0.076 | 85 | 4.8 | 2.7 | 0.29 | 0.17 |

TABLE 5-continued

| | | | | | | | | | | |
|---|---|---|---|---|---|---|---|---|---|---|
| A104 | −0.222 | −0.080 | −0.111 | 0.142 | 0.111 | 85 | 5.2 | 2.7 | 0.33 | 0.16 |
| A105 | −0.211 | −0.110 | −0.101 | 0.101 | 0.110 | 85 | 5.0 | 2.5 | 0.34 | 0.17 |
| A106 | −0.156 | −0.131 | −0.075 | 0.025 | 0.081 | 70 | 4.9 | 2.4 | 0.30 | 0.16 |
| A107 | −0.154 | −0.135 | −0.072 | 0.019 | 0.082 | 100 | 4.7 | 2.9 | 0.29 | 0.15 |
| A108 | −0.155 | −0.139 | −0.079 | 0.016 | 0.076 | 85 | 1.6 | 1.4 | 0.33 | 0.17 |
| A109 | −0.154 | −0.141 | −0.077 | 0.013 | 0.077 | 85 | 7.1 | 3.3 | 0.29 | 0.18 |
| A110 | −0.151 | −0.136 | −0.072 | 0.015 | 0.079 | 63 | 5.2 | 2.9 | 0.27 | 0.16 |
| A111 | −0.153 | −0.140 | −0.081 | 0.013 | 0.072 | 102 | 5.1 | 2.5 | 0.34 | 0.17 |
| A112 | −0.152 | −0.133 | −0.080 | 0.019 | 0.072 | 85 | 8.6 | 4.6 | 0.33 | 0.16 |
| A113 | −0.151 | −0.133 | −0.071 | 0.018 | 0.080 | 85 | 0.8 | 0.5 | 0.31 | 0.15 |
| B101 | −0.127 | −0.110 | −0.055 | 0.017 | 0.072 | 85 | 5.0 | 2.7 | 0.34 | 0.16 |
| B102 | −0.221 | −0.160 | −0.132 | 0.061 | 0.089 | 85 | 5.1 | 2.8 | 0.28 | 0.18 |
| B103 | −0.203 | −0.224 | −0.119 | −0.021 | 0.084 | 85 | 5.3 | 3.0 | 0.36 | 0.17 |

| | Dispersion | First dispersion | | Second dispersion | | Conditions in production of toner | | | |
|---|---|---|---|---|---|---|---|---|---|
| | liquid of resin | liquid of release agent particles | | liquid of release agent particles | | Amount of coagulant | Coalescence temperature | Retention temperature | Retention time |
| Toner | particles | Type | Part | Type | Part | (part) | (° C.) | (° C.) | (hour) |
| A101 | (103) | (2) | 12 | (3) | 24 | 2.1 | 91 | 85 | 1 |
| A102 | (102) | (2) | 12 | (3) | 24 | 2.1 | 92 | 85 | 1 |
| A103 | (101) | (2) | 12 | (3) | 24 | 2.1 | 93 | 85 | 1 |
| A104 | (103) | (2) | 12 | (3) | 24 | 1.9 | 92 | 85 | 1 |
| A105 | (103) | (2) | 12 | (3) | 24 | 1.7 | 91 | 85 | 1 |
| A106 | (101) | (1) | 12 | (2) | 24 | 1.7 | 77 | 70 | 1 |
| A107 | (101) | (3) | 12 | (4) | 24 | 1.7 | 108 | 95 | 1 |
| A108 | (101) | (2) | 12 | (3) | 24 | 1.7 | 91 | 85 | 0.5 |
| A109 | (101) | (2) | 12 | (3) | 24 | 1.7 | 92 | 85 | 2 |
| A110 | (103) | (1) | 28.8 | (2) | 7.2 | 1.7 | 70 | 65 | 1 |
| A111 | (103) | (3) | 7.2 | (4) | 28.8 | 1.7 | 108 | 95 | 1 |
| A112 | (103) | (2) | 12 | (3) | 24 | 1.7 | 93 | 85 | 3 |
| A113 | (103) | (2) | 12 | (3) | 24 | 1.7 | 92 | 85 | 0.25 |
| B101 | (105) | (2) | 12 | (3) | 24 | 2.1 | 91 | 85 | 1 |
| B102 | (103) | (2) | 12 | (3) | 24 | 1.5 | 93 | 85 | 1 |
| B103 | (104) | (2) | 12 | (3) | 24 | 1.5 | 93 | 85 | 1 |

Examples 101 to 152 and Comparative Examples 101 to 112

The developers shown in Tables 6 and 7 are individually put into the developing unit of a commercially available electrophotographic duplicator machine (DOCUCENTRE COLOR 450 manufactured by Fuji Xerox Co., Ltd.), and the intermediate transfer belts shown in Tables 6 and 7 are individually attached to this duplicator machines.

Evaluation

The evaluation described in "Evaluation of White Spot (Image Defect)" is carried out in both the high-temperature and high-humidity environment and the low-temperature and low-humidity environment.

TABLE 6

| | | | Intermediate transfer belt | | 28° C. 85% RH | 10° C. 15% RH |
|---|---|---|---|---|---|---|
| | | Developer | Type | Hardness | White spot | White spot |
| Example | 101 | A101 | A1 | 45 | A | A |
| | 102 | A102 | | | A | A |
| | 103 | A103 | | | A | B |
| | 104 | A104 | | | A | A |
| | 105 | A105 | | | B | A |
| | 106 | A106 | | | B | A |
| | 107 | A107 | | | A | A |
| | 108 | A108 | | | A | A |
| | 109 | A109 | | | A | A |
| | 110 | A110 | | | A | C |
| | 111 | A111 | | | B | C |
| | 112 | A112 | | | B | B |
| | 113 | A113 | | | B | A |

TABLE 6-continued

| | | | Intermediate transfer belt | | 28° C. 85% RH | 10° C. 15% RH |
|---|---|---|---|---|---|---|
| | | Developer | Type | Hardness | White spot | White spot |
| Comparative Example | 101 | B101 | | | A | D |
| | 102 | B102 | | | D | B |
| | 103 | B103 | | | D | C |
| Example | 114 | A101 | A2 | 50 | A | A |
| | 115 | A102 | | | A | A |
| | 116 | A103 | | | A | A |
| | 117 | A104 | | | A | A |
| | 118 | A105 | | | A | A |
| | 119 | A106 | | | A | A |
| | 120 | A107 | | | A | A |
| | 121 | A108 | | | A | A |
| | 122 | A109 | | | A | A |
| | 123 | A110 | | | A | C |
| | 124 | A111 | | | B | C |
| | 125 | A112 | | | B | B |
| | 126 | A113 | | | B | A |
| Comparative Example | 104 | B101 | | | A | D |
| | 105 | B102 | | | D | B |
| | 106 | B103 | | | D | C |

TABLE 7

| | | | Intermediate transfer belt | | 28° C. 85% RH | 10° C. 15% RH |
|---|---|---|---|---|---|---|
| | | Developer | Type | Hardness | White spot | White spot |
| Example | 127 | A101 | A3 | 60 | A | A |
| | 128 | A102 | | | A | A |
| | 129 | A103 | | | A | A |

TABLE 7-continued

| | | Developer | Intermediate transfer belt Type | Intermediate transfer belt Hardness | 28° C. 85% RH White spot | 10° C. 15% RH White spot |
|---|---|---|---|---|---|---|
| | 130 | A104 | | | A | A |
| | 131 | A105 | | | A | A |
| | 132 | A106 | | | A | A |
| | 133 | A107 | | | A | A |
| | 134 | A108 | | | A | A |
| | 135 | A109 | | | A | A |
| | 136 | A110 | | | A | C |
| | 137 | A111 | | | B | C |
| | 138 | A112 | | | B | B |
| | 139 | A113 | | | B | A |
| Comparative Example | 107 | B101 | | | A | D |
| | 108 | B102 | | | D | B |
| | 109 | B103 | | | D | C |
| Example | 140 | A101 | A4 | 65 | A | A |
| | 141 | A102 | | | A | A |
| | 142 | A103 | | | A | B |
| | 143 | A104 | | | A | A |
| | 144 | A105 | | | B | A |
| | 145 | A106 | | | B | A |
| | 146 | A107 | | | A | A |
| | 147 | A108 | | | A | A |
| | 148 | A109 | | | A | A |
| | 149 | A110 | | | A | C |
| | 150 | A111 | | | B | C |
| | 151 | A112 | | | B | B |
| | 152 | A113 | | | B | A |
| Comparative Example | 110 | B101 | | | A | D |
| | 111 | B102 | | | D | B |
| | 112 | B103 | | | D | C |

From Tables 6 and 7, the image defect of the occurrence of a white spot is reduced more in the image forming apparatuses of Examples using the toners that satisfy the requirements of (ln η(T1)−ln η(T2))/(T1−T2) of −0.14 or less, (ln η(T2)−ln η(T3))/(T2−T3) of −0.15 or more, and (ln η(T2)−ln η(T3))/(T2−T3) being greater than (ln η(T1)−ln η(T2))/(T1−T2) than in the image forming apparatuses of Comparative Examples using the toners that do not satisfy at least one of these requirements.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding member;

a charging unit that charges a surface of the image holding member;

an electrostatic charge image forming unit that forms an electrostatic charge image on the charged surface of the image holding member;

a developing unit that includes an electrostatic charge image developing toner and that develops the electrostatic charge image on the surface of the image holding member with the electrostatic chare image developing toner to form a toner image;

an intermediate transfer body having a circumferential surface of which micro rubber hardness is in a range of 45 to 65;

a first transfer unit that first transfers the toner image formed on the surface of the image holding member to a surface of the intermediate transfer body; and a second transfer unit that second transfers the toner image transferred to the surface of the intermediate transfer body to a recording medium, wherein the electrostatic charge image developing toner satisfies the following formulae $$(\ln \eta(T1)-\ln \eta(T2))/(T1-T2)\leq 0.14$$

$$(\ln \eta(T2)-\ln \eta(T3))/(T2-T3)\geq 0.15$$

, and $$(\ln \eta(T1)-\ln \eta(T2))/(T1-T2<(\ln \eta(T2)-\ln \eta(T3))/(T2-T3)$$

wherein η(T1) represents a viscosity of the electrostatic charge image developing toner at 60° C., η(T2) represents a viscosity of the electrostatic charge image developing toner at 90° C., and η(T3) represents a viscosity of the electrostatic charge image developing toner at 130° C., the electrostatic image developing toner comprises a binder, and the binder comprises a resin having a weight average molecular weight in a range of 33,000 to 43,000.

2. The image forming apparatus according to claim 1, wherein the electrostatic image developing toner satisfies, (lnη(T0)−lnη(T1))/(T0−T1) is −0.12 or more, and (lnη(T0)−lnη(T1))/(T0−T1) is greater than (lnη(T1)−lnη(T2))/(T1−T2), wherein η(T0) is a viscosity η of the electrostatic image developing toner at temperature T0=40° C.

3. The image forming apparatus according to claim 1, wherein the electrostatic charge image developing toner satisfies the following formula $$(\ln\eta(T1)-\ln\eta(T2))/(T1-T2)\leq -0.16.$$

4. The image forming apparatus according to claim 1, wherein the electrostatic charge image developing toner satisfies the following formula $$(\ln\eta(T2)-\ln\eta(T3))/(T2-T3)\geq -0.13.$$

5. The image forming apparatus according to claim 1, wherein the electrostatic charge image developing toner contains a release agent, and the electrostatic charge image developing toner satisfies the following formula:

$$1.0<a/b<8.0$$

wherein a is a number of domains formed of the release agent and having an aspect ratio of 5 or more in the electrostatic charge image developing toner, and b is a number of domains formed of the release agent and having an aspect ratio of less than 5 in the electrostatic charge image developing toner.

6. The image forming apparatus according to claim 1, wherein the electrostatic charge image developing toner contains a release agent, and the electrostatic charge image developing toner satisfies the following formula:

$$1.0<c/d<4.0$$

wherein c is an area of domains formed of the release agent and having an aspect ratio of 5 or more in the electrostatic charge image developing toner, and d is an area of domains formed of the release agent and having an aspect ratio of less than 5 in the electrostatic charge image developing toner.

7. The image forming apparatus according to claim 1, wherein the electrostatic charge image developing toner has a maximum endothermic peak temperature ranging from 70° C. to 100° C.

8. The image forming apparatus according to claim 1, wherein the electrostatic charge image developing toner has a maximum endothermic peak temperature ranging from 75° C. to 95° C.

9. The image forming apparatus according to claim 1, wherein the resin comprises a styrene-acrylic resin.

10. The image forming apparatus according to claim 1, wherein the resin comprises an amorphous polyester resin.

11. The image forming apparatus according to claim 1, wherein the micro rubber hardness of the circumferential surface of the intermediate transfer body is in a range of 50 to 65.

12. The image forming apparatus according to claim 1, further comprising an information acquisition unit that obtains information about a surface smoothness of the recording medium, and a pressure changing unit that changes pressure generated in the second transfer by the second transfer unit on a basis of the information.

13. The image forming apparatus according to claim 12, wherein the pressure changing unit controls the low pressure in a contact region between the highly smooth recording medium and the intermediate transfer body.

14. The image forming apparatus according to claim 12, wherein the pressure changing unit controls the high pressure in a contact region between the low smooth recording medium and the intermediate transfer body.

15. The image forming apparatus according to claim 1, wherein the circumferential surface of the intermediate transfer body includes a layer containing an elastic material.

* * * * *